US011398127B2

(12) United States Patent
Eager et al.

(10) Patent No.: US 11,398,127 B2
(45) Date of Patent: Jul. 26, 2022

(54) GAMING SYSTEMS AND METHODS USING IMAGE ANALYSIS AUTHENTICATION

(71) Applicant: SG Gaming, Inc., Las Vegas, NV (US)

(72) Inventors: Terrin Eager, Campbell, CA (US); Bryan Kelly, Kennebunk, ME (US); Martin Lyons, Henderson, NV (US)

(73) Assignee: SG Gaming, Inc., Las Vegas, NV (US)

( * ) Notice: Subject to any disclaimer, the term of this patent is extended or adjusted under 35 U.S.C. 154(b) by 57 days.

(21) Appl. No.: 17/063,897

(22) Filed: Oct. 6, 2020

(65) Prior Publication Data

US 2021/0104114 A1 Apr. 8, 2021

Related U.S. Application Data

(60) Provisional application No. 62/911,755, filed on Oct. 7, 2019.

(51) Int. Cl.
*G07F 17/32* (2006.01)

(52) U.S. Cl.
CPC ..... *G07F 17/3206* (2013.01); *G07F 17/3223* (2013.01); *G07F 17/3239* (2013.01)

(58) Field of Classification Search
CPC ..... G07F 17/3206; G07F 17/3223; G07F 17/3239
See application file for complete search history.

(56) References Cited

U.S. PATENT DOCUMENTS 5,103,081 A 4/1992 Fisher et al.
5,451,054 A 9/1995 Orenstein
5,757,876 A 5/1998 Dam et al.
6,460,848 B1 10/2002 Soltys et al.
6,501,982 B1 12/2002 Ruchti et al.
6,514,140 B1 2/2003 Storch
6,517,435 B2 2/2003 Soltys et al.
6,517,436 B2 2/2003 Soltys et al.
6,520,857 B2 2/2003 Soltys et al.
6,527,271 B2 3/2003 Soltys et al.
6,530,836 B2 3/2003 Soltys et al.
6,530,837 B2 3/2003 Soltys et al.
6,533,276 B2 3/2003 Soltys et al.
6,533,662 B2 3/2003 Soltys et al.
(Continued)

OTHER PUBLICATIONS

US 10,854,041 B2, 12/2020, Shigeta (withdrawn)
(Continued)

*Primary Examiner* — Werner G Garner

(57) ABSTRACT

A gaming terminal includes an input device, an image sensor, and logic circuitry. The logic circuitry detects user input received at the input device and that is associated with a restricted action, receives, via the image sensor, image data that corresponds to the user input, applies at least one neural network model to the image data to classify pixels of the image data as representing human characteristics including at least one face and at least one pose model, compares, based at least partially on pixel coordinates of (i) the human characteristics within the received image data and (ii) a user input zone within the image data, each of the pose models to the user input zone and the faces, and permits, in response to one of the pose models matching (i) a face of the at least one face and (ii) the user input zone, the restricted action.

20 Claims, 9 Drawing Sheets

(56) References Cited

U.S. PATENT DOCUMENTS 6,579,180 B2 6/2003 Soltys et al.
6,579,181 B2 6/2003 Soltys et al.
6,595,857 B2 7/2003 Soltys et al.
6,663,490 B2 12/2003 Soltys et al.
6,688,979 B2 2/2004 Soltys et al.
6,712,696 B2 3/2004 Soltys et al.
6,758,751 B2 7/2004 Soltys et al.
7,011,309 B2 3/2006 Soltys et al.
7,124,947 B2 10/2006 Storch
7,316,615 B2 1/2008 Soltys et al.
7,319,779 B1 1/2008 Mummareddy et al.
7,753,781 B2 7/2010 Storch
7,771,272 B2 8/2010 Soltys et al.
8,000,505 B2 8/2011 Gallagher
8,130,097 B2 3/2012 Knust et al.
8,285,034 B2 10/2012 Rajaraman et al.
8,606,002 B2 12/2013 Rajaraman et al.
8,896,444 B1 11/2014 Knust et al.
9,165,420 B1 10/2015 Knust et al.
9,174,114 B1 11/2015 Knust et al.
9,378,605 B2 6/2016 Koyama
9,511,275 B1 12/2016 Knust et al.
9,795,870 B2 10/2017 Ratliff
9,889,371 B1 2/2018 Knust et al.
10,032,335 B2 7/2018 Shigeta
10,096,206 B2 10/2018 Bulzacki et al.
10,192,085 B2 1/2019 Shigeta
10,242,525 B1 3/2019 Knust et al.
10,242,527 B2 3/2019 Bulzacki et al.
10,380,838 B2 8/2019 Bulzacki et al.
10,398,202 B2 9/2019 Shigeta
10,403,090 B2 9/2019 Shigeta
10,410,066 B2 9/2019 Bulzacki et al.
10,452,935 B2 10/2019 Li et al.
10,493,357 B2 12/2019 Shigeta
10,529,183 B2 1/2020 Shigeta
10,540,846 B2 1/2020 Shigeta
10,574,650 B2 2/2020 Wallace et al.
10,580,254 B2 3/2020 Shigeta
10,593,154 B2 3/2020 Shigeta
10,600,279 B2 3/2020 Shigeta
10,600,282 B2 3/2020 Shigeta
10,665,054 B2 5/2020 Shigeta
10,706,675 B2 7/2020 Shigeta
10,720,013 B2 7/2020 Main, Jr.
10,740,637 B2 8/2020 Garcia Rodriguez et al.
10,741,019 B2 8/2020 Shigeta
10,748,378 B2 8/2020 Shigeta
10,755,524 B2 8/2020 Shigeta
10,755,525 B2 8/2020 Shigeta
10,762,745 B2 9/2020 Shigeta
10,825,288 B1 11/2020 Knust et al.
10,832,517 B2 11/2020 Bulzacki et al.
10,846,980 B2 11/2020 French et al.
10,846,985 B2 11/2020 Shigeta
10,846,986 B2 11/2020 Shigeta
10,846,987 B2 11/2020 Shigeta
2003/0190076 A1* 10/2003 DeLean ..... G06V 40/172
382/209
2005/0059479 A1 3/2005 Soltys et al.
2006/0019739 A1 1/2006 Soltys et al.
2018/0034852 A1 2/2018 Goldenberg
2018/0053377 A1 2/2018 Shigeta
2018/0061178 A1 3/2018 Shigeta
2018/0068525 A1 3/2018 Shigeta
2018/0075698 A1 3/2018 Shigeta
2018/0114406 A1 4/2018 Shigeta
2018/0211110 A1 7/2018 Shigeta
2018/0211472 A1 7/2018 Shigeta
2018/0232987 A1 8/2018 Shigeta
2018/0239984 A1 8/2018 Shigeta
2018/0336757 A1 11/2018 Shigeta
2019/0043309 A1 2/2019 Shigeta
2019/0088082 A1 3/2019 Shigeta
2019/0102987 A1 4/2019 Shigeta
2019/0147689 A1 5/2019 Shigeta
2019/0172312 A1 6/2019 Shigeta
2019/0188957 A1 6/2019 Bulzacki et al.
2019/0188958 A1 6/2019 Shigeta
2019/0236891 A1 8/2019 Shigeta
2019/0259238 A1 8/2019 Shigeta
2019/0266832 A1 8/2019 Shigeta
2019/0318576 A1 10/2019 Shigeta
2019/0320768 A1 10/2019 Shigeta
2019/0333322 A1 10/2019 Shigeta
2019/0333323 A1 10/2019 Shigeta
2019/0333326 A1 10/2019 Shigeta
2019/0340873 A1 11/2019 Shigeta
2019/0344157 A1 11/2019 Shigeta
2019/0347893 A1 11/2019 Shigeta
2019/0347894 A1 11/2019 Shigeta
2019/0362594 A1 11/2019 Shigeta
2019/0371112 A1 12/2019 Shigeta
2020/0034629 A1 1/2020 Vo et al.
2020/0035060 A1 1/2020 Shigeta
2020/0098223 A1 3/2020 Lyons et al.
2020/0118390 A1 4/2020 Shigeta
2020/0122018 A1 4/2020 Shigeta
2020/0175806 A1 6/2020 Shigeta
2020/0202134 A1 6/2020 Bulzacki et al.
2020/0226878 A1 7/2020 Shigeta
2020/0234464 A1 7/2020 Shigeta
2020/0242888 A1 7/2020 Shigeta
2020/0258351 A1 8/2020 Shigeta
2020/0265672 A1 8/2020 Shigeta
2020/0273289 A1 8/2020 Shigeta
2020/0294346 A1 9/2020 Shigeta
2020/0302168 A1 9/2020 Vo et al.
2020/0342281 A1 10/2020 Shigeta
2020/0349806 A1 11/2020 Shigeta
2020/0349807 A1 11/2020 Shigeta
2020/0349808 A1 11/2020 Shigeta
2020/0349809 A1 11/2020 Shigeta
2020/0349810 A1 11/2020 Shigeta
2020/0349811 A1 11/2020 Shigeta
2020/0364979 A1 11/2020 Shigeta
2020/0372746 A1 11/2020 Shigeta
2020/0372752 A1 11/2020 Shigeta
2021/0307621 A1* 10/2021 Svenson ..... A61B 5/02416

OTHER PUBLICATIONS

"Face-detection-adas-0001", OpenVINO™ Toolkit, retrieved Octobers, 2020 from: https://docs.openvinotoolkit.org/latest/omz_models_intel_face_detection_adas_0001_description_face_detection_adas_0001.html, 5 pages.

"Human-pose-estimation-0001", OpenVINO™ Toolkit, retrieved Oct. 5, 2020 from: https://docs.openvinotoolkit.org/latest/omz_models_intel_human_pose_estimation_0001_description_human_pose_estimation_0001.html, 4 pages.

"ColorHandPose3D network", Computer Vision Group, Albert-Ludwigs—Universität Freiburg, retrieved Oct. 5, 2020 from: https://github.com/lmb-freiburg/hand3d, 7 pages.

Dibia, Victor, "Real-time Hand-Detection using Neural Networks (SSD) on Tensorflow.", retrieved Oct. 5, 2020 from: https://github.com/victordibia/handtracking, 17 pages.

U.S. Appl. No. 16/943,128, filed Jul. 30, 2020, 65 pages.

* cited by examiner

GAMING SYSTEMS AND METHODS USING IMAGE ANALYSIS AUTHENTICATION

CROSS REFERENCE TO RELATED APPLICATIONS

This application claims the benefit of priority to U.S. Provisional Application No. 62/911,755, filed Oct. 7, 2019, the contents of which are incorporated by reference in their entirety.

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever. Copyright 2019, SG Gaming, Inc.

FIELD

The present invention relates generally to gaming systems, apparatus, and methods and, more particularly, to authentication and authorization for restricted actions at a gaming device.

BACKGROUND

At least some gaming devices of the gaming industry are used to provide products or services to players and users without requiring an attendant to be present and fully engaged with the players. In some cases, the gaming devices facilitate providing products or services without any attendants (i.e., unattended devices). Examples of such gaming devices may include, but are not limited to, free-standing electronic gaming machines, lottery terminals, sports wager terminals, and the like.

Although these gaming devices may operate with little to no attendant overview, the gaming devices may provide products or services that may be restricted to one or more potential users. For example, wager-based games and lottery games may be age-restricted in certain jurisdictions. In another example, the gaming devices may enable a user to link a user account and/or digital wallet to a gaming session at the gaming devices, and these features may be limited to the specific user associated with the user account. As a result, security measures may be implemented by the gaming devices to limit or otherwise prevent unauthorized users from accessing such restricted activities.

However, as security measures are implemented, countermeasures may be employed by unauthorized users to access these restricted activities. The unattended (or near unattended) nature of these gaming devices may leave the gaming devices susceptible to unauthorized attempts to access restricted activities. Accordingly, further improvements for securing such gaming devices are required.

SUMMARY

According to another aspect of the disclosure, a gaming terminal includes an input device that receives physical user input from a user, an image sensor that captures image data of a user area associated with the gaming terminal and is at a predetermined location relative to the user area, and logic circuitry communicatively coupled to the input device and the image sensor. The logic circuitry detects user input received at the input device and that is associated with a restricted action, receives, via the image sensor, image data that corresponds to the user input, applies at least one neural network model to the received image data to classify pixels of the received image data as representing human characteristics including at least one face and at least one pose model, compares, based at least partially on (i) pixel coordinates of the human characteristics within the received image data and (ii) pixel coordinates of an user input zone within the image data and associated with the detected user input, each of the pose models to the user input zone and the faces, and permits, in response to one of the at least one pose model matching (i) a face of the at least one face and (ii) the user input zone, the restricted action.

According to yet another aspect of the disclosure, a method for authentication a user at a gaming terminal of a gaming system is provided. The gaming system includes at least one image sensor and logic circuitry in communication with the gaming terminal and the image sensor. The method includes receiving, by an input device of the gaming terminal, physical user input from the user and that is associated with a restricted action, receiving, by the logic circuitry via the image sensor, image data that corresponds to the physical user input, applying, by the logic circuitry, at least one neural network model to the received image data to classify pixels of the received image data as representing human characteristics including at least one face and at least one pose model, comparing, by the logic circuitry and based at least partially on (i) pixel coordinates of the human characteristics within the received image data and (ii) pixel coordinates of an user input zone within the image data and associated with the detected user input, each of the at least one pose model to the user input zone and the at least one face, and permitting, by the logic circuitry and in response to one of the at least one pose model matching (i) a face of the at least one face and (ii) the user input zone, the restricted action.

According to one yet another aspect of the present disclosure, a gaming system comprises a gaming terminal including an input device that receives physical user input from a user, an image sensor that captures image data of a user area associated with the gaming terminal and is at a predetermined location relative to the user area, and logic circuitry communicatively coupled to the input device and the image sensor. The logic circuitry detects user input received at the input device and that is associated with a restricted action, receives, via the image sensor, image data that corresponds to the user input, applies at least one neural network model to the received image data to classify pixels of the received image data as representing human characteristics including at least one face and at least one pose model, compares, based at least partially on (i) pixel coordinates of the human characteristics within the received image data and (ii) pixel coordinates of an user input zone within the image data and associated with the detected user input, each of the pose models to the user input zone and the faces, and permits, in response to one of the at least one pose model matching (i) a face of the at least one face and (ii) the user input zone, the restricted action. The gaming system may be incorporated into a single, freestanding gaming machine.

Additional aspects of the invention will be apparent to those of ordinary skill in the art in view of the detailed description of various embodiments, which is made with reference to the drawings, a brief description of which is provided below.

Figure 1:
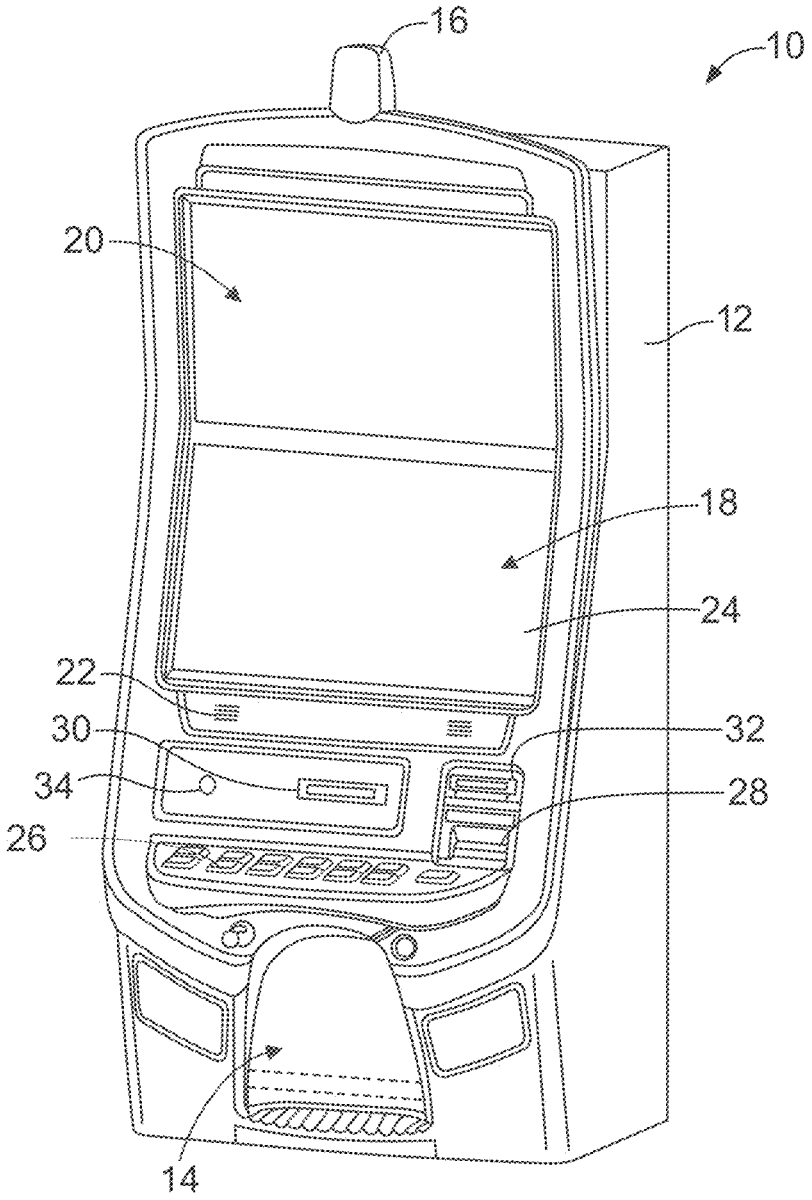
FIG. 1 is a perspective view of a free-standing gaming machine according to one or more embodiments of the present disclosure.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated. For purposes of the present detailed description, the singular includes the plural and vice versa (unless specifically disclaimed); the words "and" and "or" shall be both conjunctive and disjunctive; the word "all" means "any and all"; the word "any" means "any and all"; and the word "including" means "including without limitation."

For purposes of the present detailed description, the terms "wagering game," "casino wagering game," "gambling," "slot game," "casino game," and the like include games in which a player places at risk a sum of money or other representation of value, whether or not redeemable for cash, on an event with an uncertain outcome, including without limitation those having some element of skill. In some embodiments, the wagering game involves wagers of real money, as found with typical land-based or online casino games. In other embodiments, the wagering game additionally, or alternatively, involves wagers of non-cash values, such as virtual currency, and therefore may be considered a social or casual game, such as would be typically available on a social networking web site, other web sites, across computer networks, or applications on mobile devices (e.g., phones, tablets, etc.). When provided in a social or casual game format, the wagering game may closely resemble a traditional casino game, or it may take another form that more closely resembles other types of social/casual games.

The systems and methods described herein facilitate authorization and authentication of users at gaming devices (particularly unattended gaming devices) for restricted actions (e.g., placing a wager, accessing a player account, purchasing a lottery ticket, etc.). More specifically, the systems and methods described herein detect user input associated with a restricted action of the gaming machine and capture image data of a user area associated with a gaming device and perform image analysis to determine whether or not an authorized user is attempting to access the restricted action. The image analysis may include, but is not limited to, applying one or more neural networks to the image data for detecting and classifying one or more potential users, generating a depth map of the user, and the like. If one of the potential users matches the user input, the gaming device may perform the restricted action for the matching user or proceed with other security procedure. If none of the detected potential users match the detected user input, the systems and methods described herein prevent the restricted action from being performed and may escalate authorization for subsequent action, such as issuing an authentication challenge to the user and/or notifying an attendant. The systems and methods described herein facilitate an automatic and dynamic authentication layer to unattended gaming devices that provide additional security against unauthorized access to restricted actions.

Referring to FIG. 1, there is shown a gaming machine 10 similar to those operated in gaming establishments, such as casinos. The gaming machine 10 is one example of a gaming device that may be unattended or at least without constant attendance. With regard to the present invention, the gaming machine 10 may be any type of gaming terminal or machine and may have varying structures and methods of operation. For example, in some aspects, the gaming machine 10 is an electromechanical gaming terminal configured to play mechanical slots, whereas in other aspects, the gaming machine is an electronic gaming terminal configured to play a video casino game, such as slots, keno, poker, blackjack, roulette, craps, etc. The gaming machine 10 may take any suitable form, such as floor-standing models as shown, handheld mobile units, bartop models, workstation-type console models, etc. Further, the gaming machine 10 may be primarily dedicated for use in playing wagering games, or may include non-dedicated devices, such as mobile phones, personal digital assistants, personal computers, etc. Exemplary types of gaming machines are disclosed in U.S. Pat. Nos. 6,517,433, 8,057,303, and 8,226,459, which are incorporated herein by reference in their entireties.

The gaming machine 10 illustrated in FIG. 1 comprises a gaming cabinet 12 that securely houses various input devices, output devices, input/output devices, internal electronic/electromechanical components, and wiring. The cabinet 12 includes exterior walls, interior walls and shelves for mounting the internal components and managing the wiring, and one or more front doors that are locked and require a physical or electronic key to gain access to the interior compartment of the cabinet 12 behind the locked door. The cabinet 12 forms an alcove 14 configured to store one or more beverages or personal items of a player. A notification mechanism 16, such as a candle or tower light, is mounted to the top of the cabinet 12. It flashes to alert an attendant that change is needed, a hand pay is requested, or there is a potential problem with the gaming machine 10.

The input devices, output devices, and input/output devices are disposed on, and securely coupled to, the cabinet 12. By way of example, the output devices include a primary display 18, a secondary display 20, and one or more audio speakers 22. The primary display 18 or the secondary display 20 may be a mechanical-reel display device, a video display device, or a combination thereof in which a transmissive video display is disposed in front of the mechanical-reel display to portray a video image superimposed upon the mechanical-reel display. The displays variously display information associated with wagering games, non-wagering games, community games, progressives, advertisements, services, premium entertainment, text messaging, emails, alerts, announcements, broadcast information, subscription information, etc. appropriate to the particular mode(s) of operation of the gaming machine 10. The gaming machine 10 includes a touch screen(s) 24 mounted over the primary or secondary displays, buttons 26 on a button panel, a bill/ticket acceptor 28, a card reader/writer 30, a ticket dispenser 32, and player-accessible ports (e.g., audio output jack for headphones, video headset jack, USB port, wireless transmitter/receiver, etc.). It should be understood that numerous other peripheral devices and other elements exist and are readily utilizable in any number of combinations to create various forms of a gaming machine in accord with the present concepts.

In the example embodiment, the gaming machine 10 includes a camera 34 that, via the one or more image sensors within the camera 34, captures image data at least of a user area in front of the gaming machine 10. As used herein, the "user area" refers at least to an area in which players are expected to be or intended to be located to operate the gaming machine 10 or other gaming device. The image data may include single images or video data, and the camera 34 may be a depth camera or other form of camera that collects additional sensor data in combination with the image data. In certain embodiments, the gaming machine 10 may include additional cameras 34 and/or cameras 34 positioned in a different configuration around the gaming machine 10. In other embodiments, the gaming machine 10 may not include a camera 34, but rather a separate camera associated with the gaming machine 10 is oriented to capture the user area.

The player input devices, such as the touch screen 24, buttons 26, a mouse, a joystick, a gesture-sensing device, a voice-recognition device, and a virtual-input device, accept player inputs and transform the player inputs to electronic data signals indicative of the player inputs, which correspond to an enabled feature for such inputs at a time of activation (e.g., pressing a "Max Bet" button or soft key to indicate a player's desire to place a maximum wager to play the wagering game). The inputs, once transformed into electronic data signals, are output to game-logic circuitry for processing. The electronic data signals are selected from a group consisting essentially of an electrical current, an electrical voltage, an electrical charge, an optical signal, an optical element, a magnetic signal, and a magnetic element.

The gaming machine 10 includes one or more value input/payment devices and value output/payout devices. In order to deposit cash or credits onto the gaming machine 10, the value input devices are configured to detect a physical item associated with a monetary value that establishes a credit balance on a credit meter such as the "credits" meter 84 (see FIG. 3). The physical item may, for example, be currency bills, coins, tickets, vouchers, coupons, cards, and/or computer-readable storage mediums. The deposited cash or credits are used to fund wagers placed on the wagering game played via the gaming machine 10. Examples of value input devices include, but are not limited to, a coin acceptor, the bill/ticket acceptor 28, the card reader/writer 30, a wireless communication interface for reading cash or credit data from a nearby mobile device, and a network interface for withdrawing cash or credits from a remote account via an electronic funds transfer. In response to a cashout input that initiates a payout from the credit balance on the "credits" meter 84 (see FIG. 3), the value output devices are used to dispense cash or credits from the gaming machine 10. The credits may be exchanged for cash at, for example, a cashier or redemption station. Examples of value output devices include, but are not limited to, a coin hopper for dispensing coins or tokens, a bill dispenser, the card reader/writer 30, the ticket dispenser 32 for printing tickets redeemable for cash or credits, a wireless communication interface for transmitting cash or credit data to a nearby mobile device, and a network interface for depositing cash or credits to a remote account via an electronic funds transfer.

Figure 2:
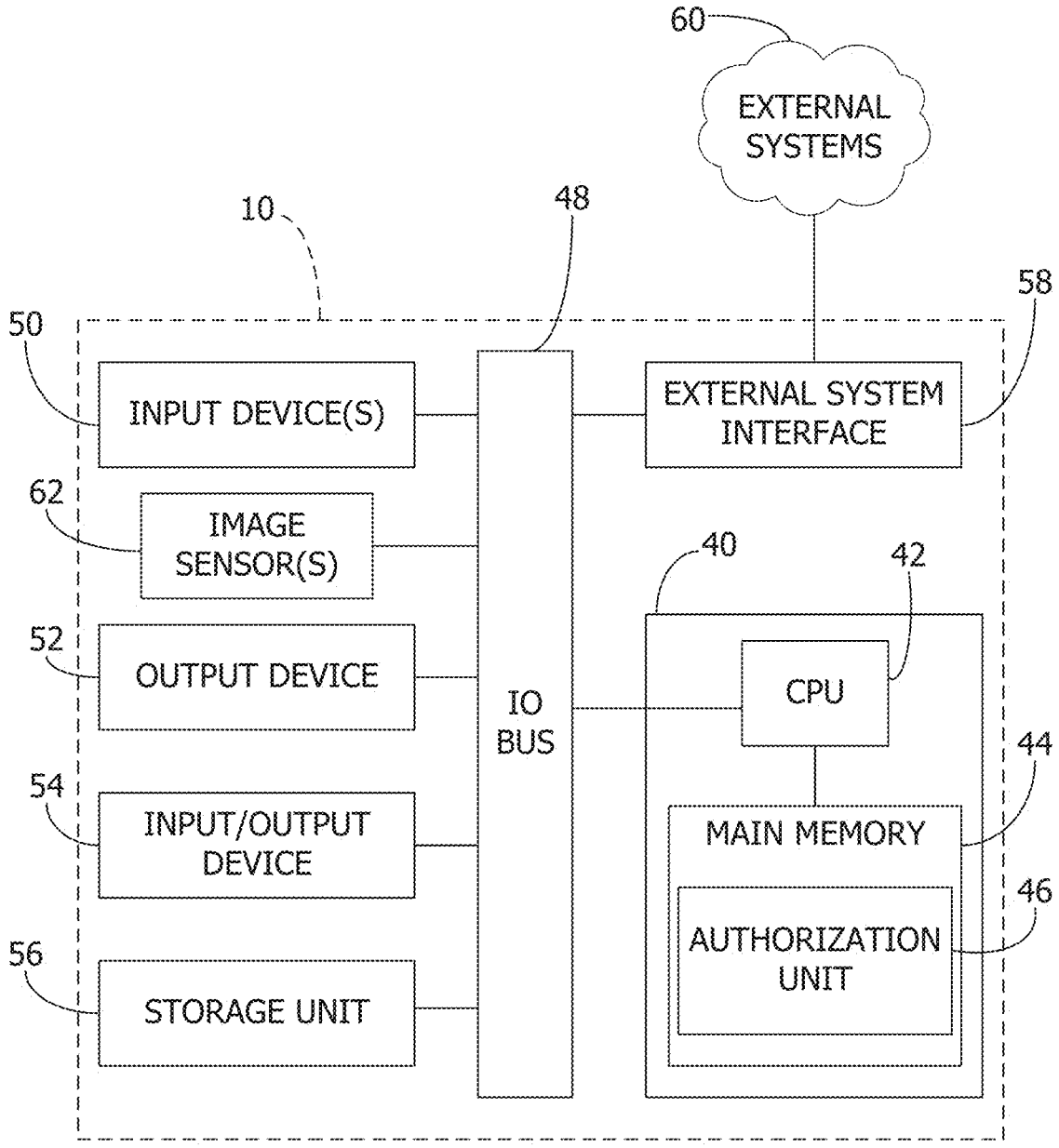
FIG. 2 is a schematic view of a gaming system in accord with at least some aspects of the disclosed concepts.

Turning now to FIG. 2, there is shown a block diagram of the gaming-machine architecture. The gaming machine 10 includes game-logic circuitry 40 securely housed within a locked box inside the gaming cabinet 12 (see FIG. 1). The game-logic circuitry 40 includes a central processing unit (CPU) 42 connected to a main memory 44 that comprises one or more memory devices. The CPU 42 includes any suitable processor(s), such as those made by Intel and AMD. By way of example, the CPU 42 includes a plurality of microprocessors including a master processor, a slave processor, and a secondary or parallel processor. Game-logic circuitry 40, as used herein, comprises any combination of hardware, software, or firmware disposed in or outside of the gaming machine 10 that is configured to communicate with or control the transfer of data between the gaming machine 10 and a bus, another computer, processor, device, service, or network. The game-logic circuitry 40, and more specifically the CPU 42, comprises one or more controllers or processors and such one or more controllers or processors need not be disposed proximal to one another and may be located in different devices or in different locations. The game-logic circuitry 40, and more specifically the main memory 44, comprises one or more memory devices which need not be disposed proximal to one another and may be located in different devices or in different locations. The game-logic circuitry 40 is operable to execute all of the various gaming methods and other processes disclosed herein. The main memory 44 includes an authorization unit 46. In one embodiment, the authorization unit 46 causes the game-logic circuitry to perform one or more authorization processes, including an authorization process incorporating image analysis as described herein. In certain embodiments, the authorization unit 46 may include one or more neural network models as described herein that, when applied to image data, causes the game-logic circuitry to classify pixels of the image data as one or more objects, such as human characteristics.

The game-logic circuitry 40 is also connected to an input/output (I/O) bus 48, which can include any suitable bus technologies, such as an AGTL+frontside bus and a PCI backside bus. The I/O bus 48 is connected to various input devices 50, output devices 52, and input/output devices 54 such as those discussed above in connection with FIG. 1.

The I/O bus 48 is also connected to a storage unit 56 and an external-system interface 58, which is connected to external system(s) 60 (e.g., wagering-game networks).

The external system 60 includes, in various aspects, a gaming network, other gaming machines or terminals, a gaming server, a remote controller, communications hardware, or a variety of other interfaced systems or components, in any combination. In the example embodiment, the external system 60 may include an attendant device that manages one or more gaming machines 10 and/or other gaming devices. The attendant device may be associated with, directly or indirectly, with a party that deploys and/or manages the gaming machine 10. For example, in a casino environment, the attendant device may be associated with the casino operator. In another example, for a gaming device deployed in a commercial environment (e.g., a lottery terminal deployed at a gas station), the attendant device may be associated with the operator of the commercial environment. In yet other aspects, the external system 60 comprises a player's portable electronic device (e.g., cellular phone, electronic wallet, etc.) and the external-system interface 58 is configured to facilitate wireless communication and data transfer between the portable electronic device and the gaming machine 10, such as by a near-field communication path operating via magnetic-field induction or a frequency-hopping spread spectrum RF signals (e.g., Bluetooth, etc.).

The gaming machine 10 optionally communicates with the external system 60 such that the gaming machine 10 operates as a thin, thick, or intermediate client. The game-logic circuitry 40—whether located within ("thick client"), external to ("thin client"), or distributed both within and external to ("intermediate client") the gaming machine 10—is utilized to provide a wagering game on the gaming machine 10. In general, the main memory 44 stores programming for a random number generator (RNG), game-outcome logic, and game assets (e.g., art, sound, etc.)—all of which obtained regulatory approval from a gaming control board or commission and are verified by a trusted authentication program in the main memory 44 prior to game execution. The authentication program generates a live authentication code (e.g., digital signature or hash) from the memory contents and compare it to a trusted code stored in the main memory 44. If the codes match, authentication is deemed a success and the game is permitted to execute. If, however, the codes do not match, authentication is deemed a failure that must be corrected prior to game execution. Without this predictable and repeatable authentication, the gaming machine 10, external system 60, or both are not allowed to perform or execute the RNG programming or game-outcome logic in a regulatory-approved manner and are therefore unacceptable for commercial use. In other words, through the use of the authentication program, the game-logic circuitry facilitates operation of the game in a way that a person making calculations or computations could not.

When a wagering-game instance is executed, the CPU 42 (comprising one or more processors or controllers) executes the RNG programming to generate one or more pseudo-random numbers. The pseudo-random numbers are divided into different ranges, and each range is associated with a respective game outcome. Accordingly, the pseudo-random numbers are utilized by the CPU 42 when executing the game-outcome logic to determine a resultant outcome for that instance of the wagering game. The resultant outcome is then presented to a player of the gaming machine 10 by accessing the associated game assets, required for the resultant outcome, from the main memory 44. The CPU 42 causes the game assets to be presented to the player as outputs from the gaming machine 10 (e.g., audio and video presentations). Instead of a pseudo-RNG, the game outcome may be derived from random numbers generated by a physical RNG that measures some physical phenomenon that is expected to be random and then compensates for possible biases in the measurement process. Whether the RNG is a pseudo-RNG or physical RNG, the RNG uses a seeding process that relies upon an unpredictable factor (e.g., human interaction of turning a key) and cycles continuously in the background between games and during game play at a speed that cannot be timed by the player, for example, at a minimum of 100 Hz (100 calls per second) as set forth in Nevada's New Gaming Device Submission Package. Accordingly, the RNG cannot be carried out manually by a human and is integral to operating the game.

The gaming machine 10 may be used to play central determination games, such as electronic pull-tab and bingo games. In an electronic pull-tab game, the RNG is used to randomize the distribution of outcomes in a pool and/or to select which outcome is drawn from the pool of outcomes when the player requests to play the game. In an electronic bingo game, the RNG is used to randomly draw numbers that players match against numbers printed on their electronic bingo card.

In the example embodiment, the gaming machine 10 further includes one or more image sensors 62 that are configured to capture image data, which may be (at least temporarily) stored by the memory unit 44 and/or the storage unit 56. In certain embodiments, the external system 60 may include one or more image sensors that transmit image data to the logic circuitry 40. The image data includes at least one user area of the gaming machine 10 such that image analysis performed of the image data may result in detection of one or more potential users of the gaming machine 10.

The gaming machine 10 may include additional peripheral devices or more than one of each component shown in FIG. 2. Any component of the gaming-machine architecture includes hardware, firmware, or tangible machine-readable storage media including instructions for performing the operations described herein. Machine-readable storage media includes any mechanism that stores information and provides the information in a form readable by a machine (e.g., gaming terminal, computer, etc.). For example, machine-readable storage media includes read only memory (ROM), random access memory (RAM), magnetic-disk storage media, optical storage media, flash memory, etc.

It is to be understood that other suitable gaming devices may be configured similar to the gaming machine described with respect to FIGS. 1 and 2. For example, a lottery kiosk or terminal may have a similar configuration to the gaming machine 10. These gaming devices may have additional, fewer, or alternative components in comparison to the gaming machine 10 shown in FIGS. 1 and 2, including components described elsewhere herein.

Figure 3:
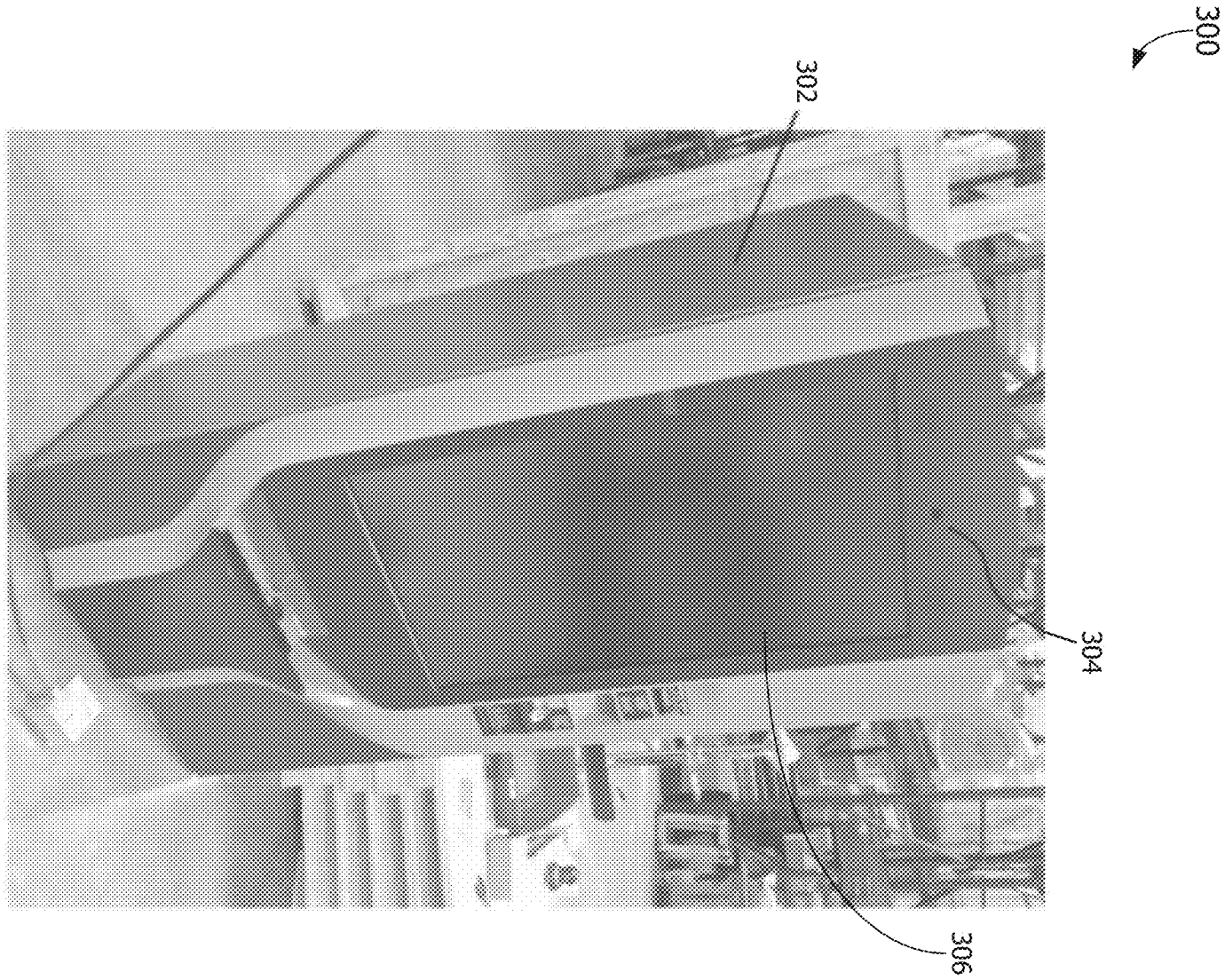
FIG. 3 is a perspective view of an example lottery gaming device in accord with at least some aspects of the disclosed concepts.

FIG. 3, for example, depicts an example lottery terminal 300 that may be incorporated into the gaming systems and methods described herein. In the example embodiment, the lottery terminal 300 includes a housing 302, a camera 304, and a touchscreen 306. Although not shown in FIG. 3, the lottery terminal may have an internal configuration with logic circuitry similar to the gaming machine shown in FIG. 2.

The camera 304 is configured to capture a user area associated with the terminal 300. More specifically, the user area is defined to include an area in front of the touchscreen 306 where users are expected to be positioned when operating the terminal 300. In certain embodiments, the camera 304 may also be configured to capture at least a portion of the touchscreen 306 to facilitate mapping the location of physical user input at the touchscreen 306 to a location within the image data captured by the camera 304 as described herein.

In some embodiments, the camera 304 may include more sensors than just an image sensor for detecting objects and/or people within the user area. In one example, the camera 304 is a depth or three-dimensional (3D) camera including additional image sensors and/or depth sensors (e.g., infrared sensors) for generating a depth map that provides depth information for each pixel in the image data captured by the camera 304, which may be used to distinguish people and objects from each other and a static background within the image data. In another example, the camera 304 may include a time-of-flight sensor to detect whether or not a potential user is located in a position relative to the terminal 300 that indicates the potential user is operating the terminal 300. That is, the time-of-flight sensor may facilitate distinguishing between people walking by the terminal at a distance from potential users standing next to the terminal 300. In other embodiments, the terminal 300 may include or be in communication with other sensors separate from the camera 304 that assist in the object detection, object classification, and/or authorization performed using sensor data from the camera 304 as described herein.

The touchscreen 306 is configured to present information to users and receive physical user input from the users to interact with the information presented on the touchscreen 306. That is, a user touches (directly or indirectly, such as via a stylus) the touchscreen 306, and the logic circuitry of the terminal 300 (or another processing component associated with the touchscreen 306) detects the coordinates of the touch on the touchscreen via a suitable touchscreen technology (e.g., resistive or capacitive). The coordinates of the touch may be referred to herein as "touch coordinates", and the touch coordinates may be matched to a portion of the displayed information to determine what, if any, action should be taken in response to the touch. For example, a user at the terminal 300 may order one or more lottery tickets by pressing the touchscreen 306 at a location corresponding to a graphical "ORDER" button.

In the systems and methods described herein, gaming devices such as the gaming machine 10 (shown in FIG. 1) and the lottery terminal 300 (shown in FIG. 3) may be configured to perform one or more restricted actions that are limited to a subset of players. For example, some actions may be restricted to prevent minors from perform illegal acts, such as wagering or purchasing lottery tickets. In another example, some actions may be limited to a particular player, such as accessing a player account or digital wallet. The gaming devices may be in environments that may result in the gaming devices being unattended during operation, which may lead to some unauthorized users to access the restricted actions through fraudulent means. In one example, the unauthorized user may hold a photograph of an authorized user (via a printed photograph or a display device, such as a smartphone) in front of his or her face to trick facial recognition software into performing a restricted action. Although an attendant may be able to swiftly identify such acts as suspicious or fraudulent, it may not be feasible for the attendant to maintain real-time, constant attendance of the gaming devices.

The systems and methods described herein capture image data of a user area for a gaming device, perform image analysis of the captured image data to detect potential users within the user area, and determine whether or not an authorized user is attempting to access a restricted action of the gaming device. If it is determined the authorized user is in fact attempting to access the restricted action, the gaming device performs the restricted action (or proceeds to additional security measures implemented by the gaming device). If not, then the gaming device may escalate to additional authentication challenges and/or notifying an attendant of suspicious activity.

In some embodiments, the logic circuitry that performs at least a portion of the functionality described herein with respect to the gaming devices may be separate from the gaming device. For example, the logic circuitry may be within a server-computing device in communication with the gaming device to receive image data from the gaming device (or a separate image sensor associated with the gaming device) and transmit a message to the gaming device in response to determining the authorization status of the user. The server-computing device may be in communication with a plurality of gaming devices to perform the functionality described herein.

Figure 4:
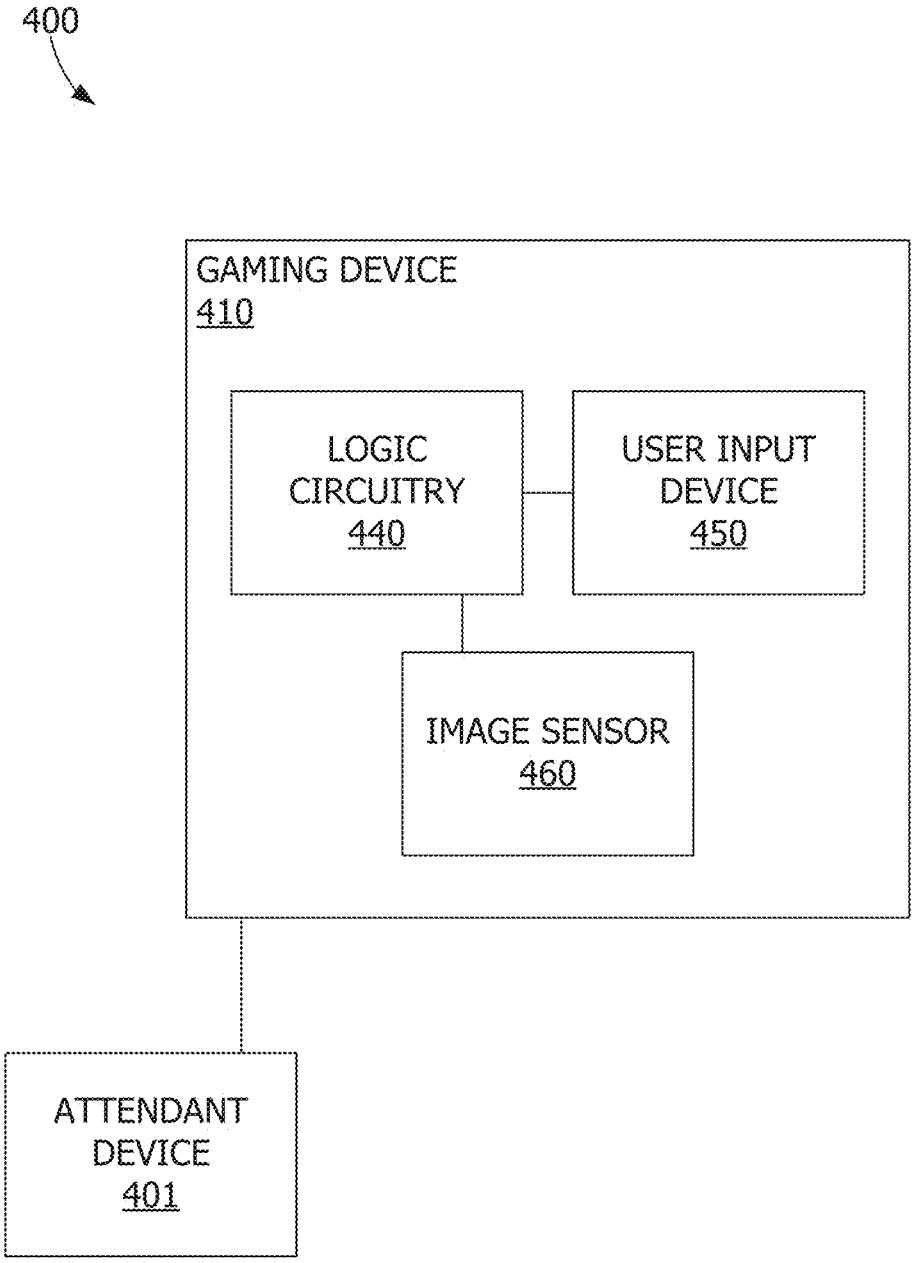
FIG. 4 is a block diagram of an example gaming system in accord with at least some aspects of the disclosed concepts.

FIG. 4 is a block diagram of an example gaming system 400 including a gaming device 410. The gaming device 410 includes logic circuitry 440, one or more user input devices 450, and one or more image sensors 460 similar to the components shown in FIG. 2. In other embodiments, the gaming device 410 may include additional, fewer, or alternative components, including those described elsewhere herein. In certain embodiments, the system 400 may include additional or alternative components, such as the logic circuitry 440, the input device 450, and/or the image sensor 460 being separate from the gaming device 410.

The input device 450 is in communication with the logic circuitry 440 and is configured to receive physical user input from a user. The physical user input may vary according to the form and functionality of the input device 450. For example, a touchscreen may receive touch input, while a button might be pressed, or a joystick may be moved. The input device 450 enables a user to interact with the gaming device 410. In the example embodiment, at least one restricted action of the gaming device 410 may be selectable using the input device 450. That is, the user may provide user input via the input device 450 to prompt the gaming device 410 to perform one or more restricted actions, such as, but not limited to, placing wagers and/or purchasing lottery tickets. The logic circuitry 440 may be configured to detect the physical user input and the selection of a restricted action, which may cause the logic circuitry 440 to initiate an authorization process as described herein.

The image sensor 460 is configured to capture image data of a user area associated with the gaming device 410 and transmit the image data to the logic circuitry 440. The image data may be continuously captured at a predetermined framerate or periodically. In one example, if user input associated with a restricted action is detected, the logic circuitry 440 causes the image sensor 460 to capture the image data. In some embodiments, the image sensor 460 is configured to transmit the image data with limited image processing or analysis such that the logic circuitry 440 and/or another device receiving the image data performs the image processing and analysis. In other embodiments, the image sensor 460 may perform at least some preliminary image processing and/or analysis prior to transmitting the image data. In such embodiments, the image sensor 460 may be considered an extension of the logic circuitry 440, and as such, functionality described herein related to image processing and analysis that is performed by the logic circuitry 440 may be performed by the image sensor 460 (or a dedicated computing device of the image sensor 460).

The logic circuitry 440 is configured to establish data structures relating to each potential user detected in the image data from the image sensor 460. In particular, in the example embodiment, the logic circuitry 440 applies one or more image neural network models during image analysis that are trained to detect aspects of humans. Neural network models are analysis tools that classify "raw" or unclassified input data without requiring user input. That is, in the case of the raw image data captured by the image sensor 460, the neural network models may be used to translate patterns within the image data to data object representations of, for example, faces, hands, torsos etc., thereby facilitating data storage and analysis of objects detected in the image data as described herein. The neural network models may be implemented via software modules executed by the logic circuitry 440 and/or implemented via hardware of the logic circuitry 440 dedicated to at least some functionality of the neural network models.

At a simplified level, neural network models are a set of node functions that have a respective weight applied to each function. The node functions and the respective weights are configured to receive some form of raw input data (e.g., image data), establish patterns within the raw input data, and generate outputs based on the established patterns. The weights are applied to the node functions to facilitate refinement of the model to recognize certain patterns (i.e., increased weight is given to node functions resulting in correct outputs), and/or to adapt to new patterns. For example, a neural network model may be configured to receive input data, detect patterns in the image data representing human faces, and generate an output that classifies one or more portions of the image data as representative of human faces (e.g., a box having coordinates relative to the image data that encapsulates a face and classifies the encapsulated area as a "face" or "human").

To train a neural network to identify the most relevant guesses for identifying a human face, for example, a predetermined dataset of raw image data including human faces and with known outputs is provided to the neural network. As each node function is applied to the raw input of a known output, an error correction analysis is performed such that node functions that result in outputs near or matching the known output may be given an increased weight while node functions having a significant error may be given a decreased weight. In the example of identifying a human face, node functions that consistently recognize image patterns of facial features (e.g., nose, eyes, mouth, etc.) may be given additional weight. The outputs of the node functions (including the respective weights) are then evaluated in combination to provide an output such as a data structure representing a human face. Training may be repeated to further refine the pattern-recognition of the model, and the model may still be refined during deployment (i.e., raw input without a known data output).

At least some of the neural network models applied by the logic circuitry 440 may be deep neural network (DNN) models. DNN models include at least three layers of node functions linked together to break the complexity of image analysis into a series of steps of increasing abstraction from the original image data. For example, for a DNN model trained to detect human faces from an image, a first layer may be trained to identify groups of pixels that may represent the boundary of facial features, a second layer may be trained to identify the facial features as a whole based on the identified boundaries, and a third layer may be trained to determine whether or not the identified facial features form a face and distinguish the face from other faces. The multi-layered nature of the DNN models may facilitate more targeted weights, a reduced number of node functions, and/or pipeline processing of the image data (e.g., for a three-layered DNN model, each stage of the model may process three frames of image data in parallel).

In at least some embodiments, each model applied by the logic circuitry 440 may be configured to identify a particular aspect of the image data and provide different outputs such that the logic circuitry 440 may aggregate the outputs of the neural network models together to distinguish between potential users as described herein. For example, one model may be trained to identify human faces, while another model may be trained to identify the bodies of players. In such an example, the logic circuitry 440 may link together a face of a player to a body of the player by analyzing the outputs of the two models. In other embodiments, a single DNN model may be applied to perform the functionality of several models.

The inputs of the neural network models, the outputs of the neural network models, and/or the neural network models themselves may be stored in one or more data structures that may be retrieved for subsequent use. In certain embodiments, the logic circuitry 440 may store the inputs and/or outputs in data structures associated with particular potential users. That is, data structures may be retrieved and/or generated for a particular user such the user may be known during subsequent image analysis (via unique human characteristics detected by the neural network models) to the system 400. It is to be understood that the underlying data storage of the user data may vary in accordance with the computing environment of the memory device or devices that store the data. That is, factors such as programming language and file system structures (e.g., FAT, exFAT, ext4, NTFS, etc.) may vary the where and/or how the data is stored (e.g., via a single block allocation of data storage, via distributed storage with pointers linking the data together, etc.). In addition, some data may be stored across several different memory devices or databases.

Although the output of the image neural network models may vary depending upon the specific functionality of each model, the outputs generally include one or more data elements that represent a physical feature or characteristic of a person or object in the image data in a format that can be recognized and processed by logic circuitry 440 and/or other computing devices. For example, one example neural network model may be used to detect the faces of players in the image data and output a map of data elements representing "key" physical features of the detected faces, such as the corners of mouths, eyes, nose, ears, etc. The map may indicate a relative position of each facial feature within the space defined by the image data (in the case of a singular, two-dimensional image, the space may be a corresponding two-dimensional plane) and cluster several facial features together to distinguish between detected faces. The output map is a data abstraction of the underlying raw image data that has a known structure and format, which may be advantageous for use in other devices and/or software modules.

In the example embodiment, applying the image neural network models to the image data causes the logic circuitry 440 to generate one or more key user data elements. The key player user elements are the outputs of the image processing (including the neural network models). Other suitable image processing techniques and tools may be implemented by the logic circuitry 440 in place of or in combination with the neural network models. As described above, the key user data elements represent one or more physical characteristics of the potential users (e.g., a face, a head, a limb, an extremity, or a torso) detected in the image data. The key user data elements may include any suitable amount and/or type of data based at least partially on the corresponding neural network model. At least some of the key user data elements include position data indicating a relative position of the represented physical characteristics within a space at least partially defined by the scope of the image data. The position data may be represented as pixel coordinates within the image data.

The key user data elements may include, but are not limited to, boundary boxes, key feature points, vectors, wireframes, outlines, pose models, and the like. Boundary boxes are visual boundaries that encapsulate an object in the image and classify the encapsulated object according to a plurality of predefined classes (e.g., classes may include "human", "tokens", etc.). A boundary box may be associated with a single class or several classes (e.g., a player may be classified as both a "human" and a "male"). The key feature points, similar to the boundary boxes, classify features of objects in the image data, but instead assign a singular position (i.e., pixel coordinates) to the classified features. In certain embodiments, the logic circuitry 440 may include neural network models trained to detect objects other than the players. For example, the logic circuitry 440 may include a neural network model trained to detect display devices (e.g., a smartphone or tablet) that are displaying faces within the image data. In such an example, the logic circuitry 440 may automatically determine that a potential user is attempting to trick the system 400 into providing unauthorized access to the restricted action. The logic circuitry 440 may prevent the restricted action from being performed and/or notify an attendant of the potential fraud.

Although the key user data elements are described above as outputs of the neural network models, at least some key user data elements may be generated using other object detection and/or classification techniques and tools. For example, a 3D camera of the sensor system 106 (shown in FIG. 1) may generate a depth map that provides depth information related to the image data such that objects may be distinguished from each other and/or classified based on depth, and at least some key user data elements may be generated from the depth map. In such embodiments, the logic circuitry may filter at least some key user data elements that represent human features beyond a certain distance from the gaming device 410. That is, the logic circuitry 440 compares the depth data of the key user data elements to a depth threshold, and key user data elements exceeding the threshold may be removed from the analysis described herein. In another example, a LIDAR sensor of the gaming device 410 may be configured to detect objects to generate key user data elements. In certain embodiments, the neural network models may be used with other object detection tools and systems to facilitate classifying the detected objects.

In addition to detecting potential users, the logic circuitry 440 is configured to establish one or more user input zones within the image data. A user input zone is a portion of the image data representing an area including one of the user input devices 450 and/or an area proximal to the user input device 450 from which a user would operate the user input device 450. For example, for a touchscreen, the user input zone may include pixels representing an area near the touchscreen that is likely to be occupied by a user's hand to operate the touchscreen. The user input zone may also capture the touchscreen itself to enable the logic circuitry to identify human characteristics in the image data (e.g., a finger or a hand) that correspond to the detected user input on the touchscreen. The user input zone may be static and predefined, or the user input zone may be at least partially a function of the detected user input. For example, with a touchscreen, user input is detected with touch coordinates indicating an area or point on the touchscreen that the user has selected. The logic circuitry 440 may be configured to map the touch coordinates to input coordinates within the image data to define the user input zone. This variable input zone enables the logic circuitry 440 to accurately detect which user has provided the user input associated with the restricted action even in the event that multiple user inputs are provided simultaneously.

Based on the analysis of the neural network outputs, the logic circuitry 440 is configured to determine whether or not the potential user associated with the user input is an authorized user or, more broadly, whether or not potential suspicious behavior or users are detected. That is, if the outputs of the neural network do not match as expected, this may indicate that the user is attempting access the restricted action fraud or other unauthorized means, such as holding a picture of an authorized user in front of his or her face. In response to detecting the suspicious behavior, the logic circuitry 440 may escalate the authorization process or outright block the restricted action from being performed. Escalating the authorization process may involve one or more actions by the logic circuitry 440 and/or other devices associated with authorizing users, such as an attendant device 401 in communication with the gaming device 410. The actions may include, but are not limited to, presenting an additional authorization challenge to the user (e.g., requesting additional user input), alerting the attendant device 401, emitting audiovisual cues from the gaming device 410 indicating potential suspicious behavior, notifying an authorized user of potential fraud via text messages, email, or phone calls, and the like. These actions may deter the unauthorized user from further attempts or facilitate identification of the unauthorized user. In contrast to an unauthorized user, the system 400 is configured to enable an authorized user to initiate a restricted action via the gaming device 410 with little to no interruption.

In at least some embodiments, the logic circuitry 440 may be further configured to generate annotated image data from the image analysis. The annotated image data may be the image data with at least the addition of graphical and/or metadata representations of the data generated by the logic circuitry 440. For example, if the logic circuitry 440 generates a bounding box encapsulating a hand, a graphical representation of the boundary box may be applied around the pixels representing the hand to the image data to represent the generated boundary box. The annotated image data may be an image filter that is selectively applied to the image data or an altogether new data file that aggregates the image data with data from the logic circuitry 440. The annotated image data may be stored as individual images and/or as video files. Although the following describes the user data elements as graphical objects annotated on an image, it is to be understood that the underlying data elements may be used by the logic circuitry 440 to perform the analysis and authorization processes described herein irrespective of generating the annotated image data. Rather, the annotated image data may be used to facilitate human-comprehension of the underlying data elements generated, analyzed, and stored by the logic circuitry 440 as described herein.

Figure 5:
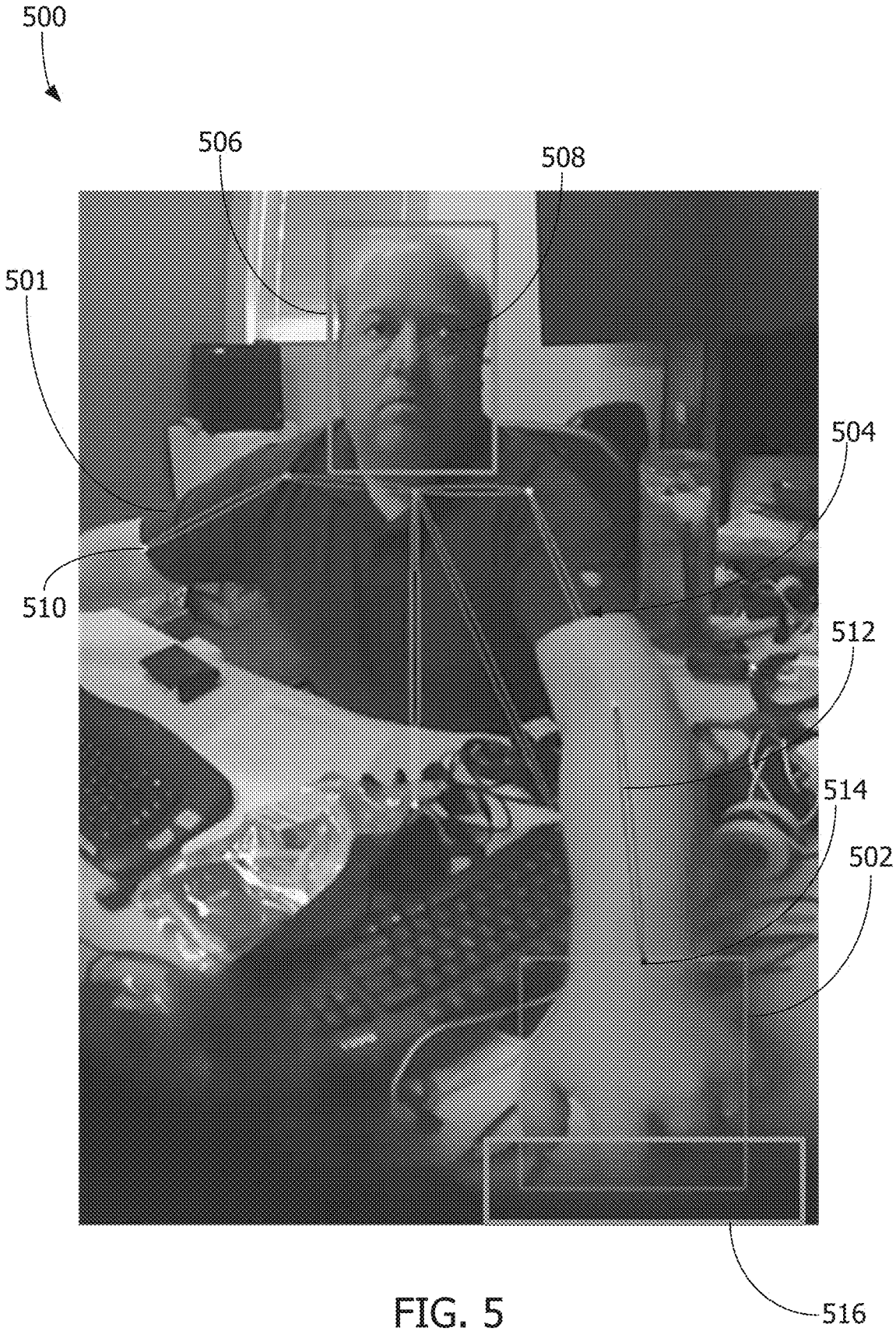
FIG. 5 is an example image captured by a gaming device in accord with at least some aspects of the disclosed concepts.

FIG. 5 is an example annotated image frame 500 of a potential user 501 using the system 400 shown in FIG. 4. More specifically, the user 501 has touched a touchscreen below the frame 500 to attempt to access a restricted action. The frame 500 has been captured in response to the detected user input, and the logic circuitry 440 shown in FIG. 4 has performed image analysis via one or more neural networks on the frame 500 to generate the annotations (i.e., key user data elements).

In the example embodiment, the logic circuitry 440 is configured to detect three aspects of players in captured image data: (i) faces, (ii) hands, and (iii) poses. As used herein, "pose" or "pose model" may refer physical characteristics that link together other physical characteristics of a player. For example, a pose of the user 501 may include features from the face, torso, and/or arms of the user 501 to link the face and hands of the user 501 together. The graphical representations shown include a hand boundary box 502, a pose model 504, and a face or head boundary box 506, and facial feature points 508.

The hand boundary box 502 is the output of one or more neural network models applied by the logic circuitry 440. The boundary box 502 may be a visual or graphical representation of one or more underlying key user data elements. For example, and without limitation, the key user data elements may specify coordinates within the frame 500 for each corner of the boundary box 502, a center coordinate of the boundary box 502, and/or vector coordinates of the sides of the boundary box 502. Other key user data elements may be associated with the boundary box 502 that are not used to specify the coordinates of the box 502 within the frame 500 such as, but not limited to, classification data (i.e., classifying the object in the frame 500 as a "hand"). The classification of a hand detected in captured image data may be by default a "hand" classification and, if sufficiently identifiable from the captured image data, may further be classified into a "right hand" or "left hand" classification. As described in further detail herein, the hand boundary box 502 may be associated with the user 501, which is which may be illustrated by displaying a user identifier with the hand boundary box 502.

In the example embodiment, the pose model 504 is used to link together outputs from the neural network models to associate the outputs with a single player (e.g., the user 501). That is, the key user data elements generated by the logic circuitry 440 are not associated with a player immediately upon generation of the key user data elements. Rather, the key user data elements are pieced or linked together to form a player data object as described herein. The key user data elements that form the pose model 504 may be used to find the link between the different outputs associated with a particular player.

In the example embodiment, the pose model 504 includes pose feature points 510 and connectors 512. The pose feature points 510 represent key features of the user 501 that may be used to distinguish the user 501 from other players and/or identify movements or actions of the user 501. For example, the eyes, ears, nose, mouth corners, shoulder joints, elbow joints, and wrists of the user 501 may be represented by respective pose feature points 510. The pose feature points 510 may include coordinates relative to the captured image data to facilitate positional analysis of the different feature points 510 and/or other key user data elements. The pose feature points 510 may also include classification data indicating which feature is represented by the respective pose feature point 510. The connectors 512 visually link together the pose feature points 510 for the user 501. The connectors 512 may be extrapolated between certain pose feature points 510 (e.g., a connector 512 is extrapolated between pose feature points 510 representing the wrist and the elbow joint of the user 501). In some embodiments, the pose feature points 510 may be combined (e.g., via the connectors 512 and/or by linking the feature points 510 to the same player) by one or more corresponding neural network models applied by the logic circuitry 440 to captured image data. In other embodiments, the logic circuitry 440 may perform one or more processes to associate the pose feature points 510 to a particular user. For example, the logic circuitry 440 may compare coordinate data of the pose feature points 510 to identify a relationship between the represented physical characteristics (e.g., an eye is physically near a nose, and therefore the eye and nose are determined to be part of the same player).

At least some of the pose feature points 510 may be used to link other key user data elements to the pose model 504 (and, by extension, the user 501). More specifically, at least some pose feature points 510 may represent the same or nearby physical features or characteristics as other key user data elements, and based on a positional relationship between the pose feature point 510 and another key user data element, a physical relationship may be identified. In one example described below, the pose feature points 510 include wrist feature points 514 that represent wrists detected in captured image data by the logic circuitry 440. The wrist feature points 514 may be compared to one or more hand boundary boxes 502 (or vice versa such that a hand boundary box is compared to a plurality of wrist feature points 514) to identify a positional relationship with one of the hand boundary boxes 502 and therefore a physical relationship between the wrist and the hand.

Figure 6:
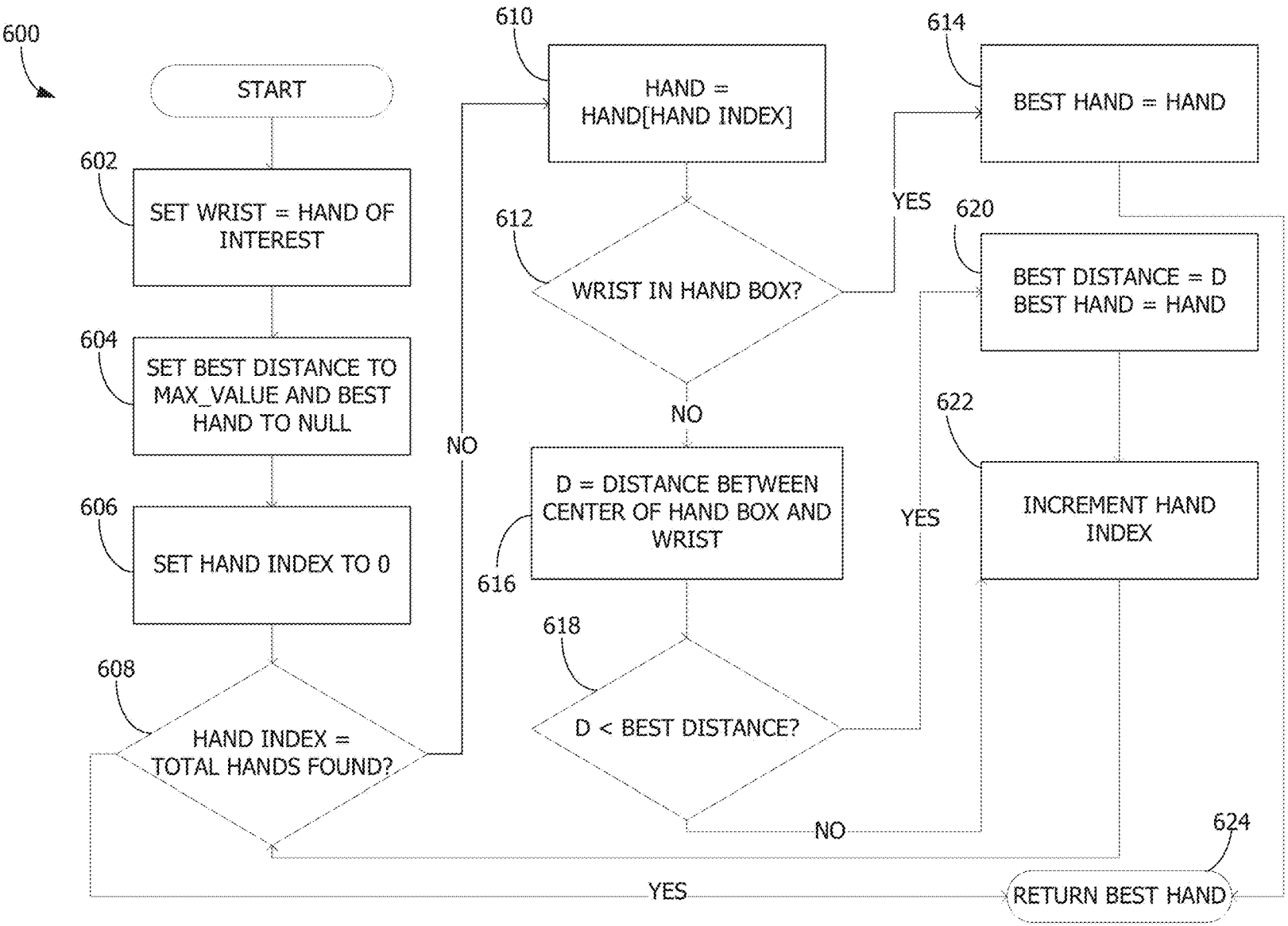
FIG. 6 is a flow diagram of an example method for linking key user data elements representing hands to a potential user in accord with at least some aspects of the disclosed concepts.

FIG. 6 illustrates an example method 600 for linking a hand boundary box to a pose model, thereby associating the hand with a particular user. The method 600 may be used, for example, in images with a plurality of hands and poses detected to determine which hands are associated with a given pose. In other embodiments, the method 600 may include additional, fewer, or alternative steps, including those described elsewhere herein. The steps below may be described in algorithmic or pseudo-programming terms such that any suitable programming or scripting language may be used to generate the computer-executable instructions that cause the logic circuitry 440 (shown in FIG. 4) to perform the following steps. In certain embodiments, at least some of the steps described herein may be performed by other devices in communication with the logic circuitry 440.

In the example embodiment, the logic circuitry 440 sets 602 a wrist feature point of a pose model as the hand of interest. That is, the coordinate data of the wrist feature point and/or other suitable data associated with the wrist feature point for comparison with key user data elements associated with hands are retrieved for use in the method 600. In addition to establishing the wrist feature point as the hand of interest, several variables are initialized prior to any hand comparison. In the example embodiment, the logic circuitry 440 sets 604 a best distance value to a predetermined max value and a best hand variable to 'null'. The best distance and best hand variables are used in combination with each other to track the hand that is the best match to the wrist of the wrist feature point and to facilitate comparison with subsequent hands to determine whether or not the subsequent hands are better matches for the wrist. The logic circuitry 440 may also set 606 a hand index variable to '0'.

In the example embodiment, the key user data elements associated with each hand within the captured image data may be stored in an array such that each cell within the hand array is associated with a respective hand. The hand index variable may be used to selectively retrieve data associated with a particular hand from the hand array.

At step 608, the logic circuitry 440 determines whether or not the hand index is equal to (or greater than, depending upon the array indexing format) the total number of hands found within the captured image data. For the initial determination, the hand index is 0, and as a result, the logic circuitry 440 proceeds to set 610 a prospective hand for comparison to the hand associated with the first cell of the hand array (in the format shown in FIG. 6, HAND[ ] is the hand array, and HAND[0] is the first cell of the hand array, where '0' is the value indicated by the HAND INDEX). In the example embodiment, the data stored in the hand array for each hand may include coordinate data of a hand boundary box. The coordinate data may a center point of the boundary box, corner coordinates, and/or other suitable coordinates that may describe the position of the hand boundary box relative to the captured image data.

The logic circuitry 440 determines 612 whether or not the wrist feature point is located within the hand boundary box of the hand from the hand array. If the wrist feature point is located with the hand boundary box, then the hand may be considered a match to the wrist and the potential user. In the example embodiment, the logic circuitry 440 may then set 614 the hand as the best hand and return 624 the best hand. The best hand may then be associated with the pose model and stored as part of a user data object of the user (i.e., the hand is "linked" to the user). Returning 624 the best hand may terminate the method 600 without continuing through the hand array, thereby freeing up resources of the logic circuitry 440 for other functions, such as other iterations of the method 600 for different wrist feature points and pose models. In other embodiments, the logic circuitry 440 may compare the wrist feature point to each and every hand prior to returning 624 the best hand irrespective of whether the wrist feature point is located within a hand boundary box, which may be beneficial in image data with crowded bodies and hands.

If the wrist feature point is not determined to be within the hand boundary box of the current hand, the logic circuitry 440 calculates 616 a distance between the center of the hand boundary box and the wrist feature point. The logic circuitry 440 then compares 618 the calculated distance to the best distance variable. If the calculated distance is less than the best distance, the current hand is, up to this point, the best match to the wrist feature point. The logic circuitry 440 sets 620 the best distance variable equal to the calculated distance and the best hand to be the current hand. For the first hand from the hand array, the comparison 618 may automatically progress to setting 620 the best distance to the calculated distance and the best hand to the first hand because the initial best distance may always be greater than the calculated distance. The logic circuitry 440 then increments 622 the hand index such that the next hand within the hand array will be analyzed through steps 610-622. The hand index is incremented 622 irrespective of the comparison 618, but step 620 is skipped if the calculated distance is greater than or equal to the best distance.

After each hand of the hand array is compared to the wrist feature point, the hand index is incremented to value beyond the addressable values of the hand array. During the determination 608, if the hand index is equal to the total number of hands found (or greater than in instances in which the first value of the hand array is addressable with a hand index of '1'), then every hand has been compared to the wrist feature point, and the best hand to match the wrist feature point may be returned 624. In certain embodiments, to avoid scenarios in which the real hand associated with a wrist is covered from view of the capture image data and the best hand as determined by the logic circuitry 440 is relatively far away from the wrist, the logic circuitry 440 may compare the best distance associated with the best hand to a distance threshold. If the best distance is within the distance threshold (i.e., less than or equal to the minimum distance), the best hand may be returned 624. However, if the best distance is greater than the distance threshold, the best hand variable may be set back to a 'null' value and returned 624. The null value may indicate to other modules of the logic circuitry 440 and/or other devices that the hand associated with the wrist is not present in the captured image data.

Figure 7:
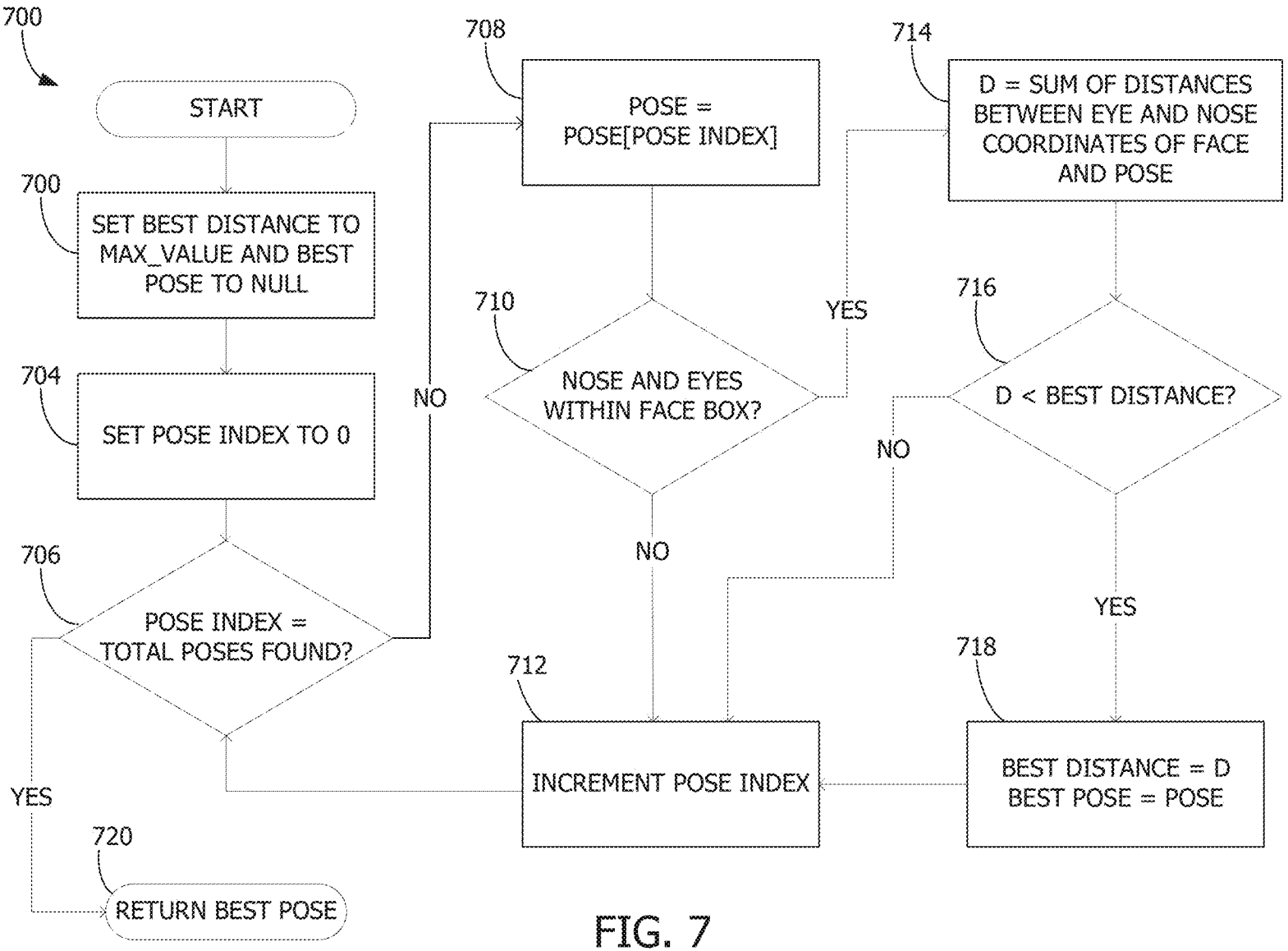
FIG. 7 is a flow diagram of an example method for linking key user data elements representing a face of a potential user to a corresponding body of the potential user in accord with at least some aspects of the disclosed concepts.

FIG. 7 illustrates a flow diagram of an example method 700 for linking a pose model to a particular face. The method 700 shares some similarities to the method 600 shown in FIG. 6, but also includes several contrasting aspects. Most notably, the method 700 is a comparison of a plurality of pose models to a single face to identify a matching pose model for the face rather than a plurality of hands compared to a single pose model with respect to the method 600. It is to be understood that the method 700 may be performed using steps similar to the method 600 (i.e., compare a single pose model to a plurality of faces), and vice versa. In other embodiments, the method 700 may include additional, fewer, or alternative steps, including those described elsewhere herein. The steps below may be described in algorithmic or pseudo-programming terms such that any suitable programming or scripting language may be used to generate the computer-executable instructions that cause the logic circuitry 440 (shown in FIG. 4) to perform the following steps. In certain embodiments, at least some of the steps described herein may be performed by other devices in communication with the logic circuitry 440.

In the example embodiment, to initiate the method 700, the logic circuitry 440 may retrieve or be provided inputs associated with a face detected in captured image data. More specifically, key user data elements representing a face and/or head are used to link the face to a pose model representing a body detected in the captured image data. The key user data elements representing the face may include a face or head boundary box and/or face feature points. The boundary box and/or the face feature points may include coordinate data for identifying a location of the boundary box and/or the face feature points within the captured image data. The pose model may include pose feature points representing facial features (e.g., eyes, nose, ears, etc.) and/or physical features near the face, such as a neck. In the example embodiment, the inputs associated with the face include a face boundary box and facial feature points representing the eyes and nose of the face. Each pose includes pose feature points representing eyes and a nose and including coordinate data for comparison with the inputs of the face.

To initialize the method 700, the logic circuitry 440 sets 702 a best distance variable to a predetermined maximum value and a best pose variable to a 'null' value. Similar to the hand array described with respect to FIG. 6, the logic circuitry 440 stores data associated with every detected pose model in a pose array that is addressable via a pose array index variable. Prior to comparing the poses to the face, the logic circuitry 440 sets 704 the pose index variable to a value of '0' (or '1' depending upon the syntax of the array).

The logic circuitry 440 then determines 706 if the pose index is equal to (or greater than for arrays with an initial index value of '1') a total number of poses detected in the captured image data. If the pose index is determined 706 not to be equal to the total number of poses, the logic circuitry 440 progress through a comparison of each pose with the face. The logic circuitry 440 sets 708 the current pose to be equal to the pose stored in the pose array at the cell indicated by the pose index. For the first comparison, the current pose is stored as 'POSE[0]' according to the syntax shown in FIG. 7. The data associated with the current pose is retrieved form the pose array for comparison with the input data associated with the face.

In the example embodiment, the logic circuitry 440 compares 710 the pose feature points representing a pair of eyes and a corresponding nose to the face boundary box of the face. If the pose feature points representing the eyes and nose are not within the face boundary box, the pose is unlikely to be a match to the face, and the logic circuitry 440 increments 712 the pose index such that the comparison beginning at step 708 begins again for the next pose. However, if the pose feature points are within the face boundary box, the logic circuitry 440 then calculates 714 a distance from the pose feature points and facial feature points. In the example embodiment, Equation 1 is used to calculate 714 the distance D, where $\text{left_eye}_p$, $\text{right_eye}_p$, and $\text{nose}_p$ are coordinates of pose feature points representing a left eye, a right eye, and a nose of the pose model, respectively, and where $\text{left_eye}_f$, $\text{right_eye}_f$, and $\text{nose}_f$ are coordinates of facial feature points representing a left eye, a right eye, and a nose of the face, respectively.

$$D=|\text{left_eye}_p-\text{left_eye}_f|+|\text{right_eye}_p-\text{right_eye}_f|+|\text{nose}_p-\text{nose}_f| \quad (1)$$

In other embodiments, other suitable equations may be used to calculate 714 the distance. The logic circuitry 440 then compares 716 the calculated distance to the best distance variable. If the calculated distance is greater than or equal to the best distance, the pose is determined to not be a match to the face, and the pose index is incremented 712. However, if the calculated distance is less than the best distance, the current pose may be, up to this point, the best match to the face. The logic circuitry 440 may then set 718 the best distance to the calculated distance and the best pose variable to the current pose. For the first pose compared to the face within steps 706-718, the first pose may automatically be the assigned as the best pose because the of the initialized values of step 702. The logic circuitry 440 then increments 712 the pose index to continue performing steps 706-718 until every pose within the pose array has been compared. Once every pose has been compared, the pose index will be equal to or greater than the total number of detected poses, and therefore the logic circuitry 440 determines 706 that the method 700 is complete and returns 720 the best pose to be linked to the face.

Unlike the method 600, the method 700 does not include steps to conclude the comparison loop (i.e., steps 706-718) until every pose has been compared to ensure that an early 'false positive' within the pose array does not result in the method 700 ending without locating the best possible pose to link to the face. However, it is to be understood that the method 700 may include additional and/or alternative steps to conclude the comparison loop without comparing every pose, particularly in embodiments in which (i) resource allocation of the logic circuitry 440 may be limited due to number of parallel processes, time constraints, etc., and/or (ii) a reasonable amount of certainty can be achieved in the comparison loop that a pose is linked to the face similar to steps 1012 and 1014 in FIG. 10.

The method 700 further includes protections against situations in which the body associated with the face is obscured from the captured image data, and the face is erroneously linked to a different pose. More specifically, the comparison 710 requires at least some positional relationship between the pose and the face to be in consideration as the best pose to match the face. If the body associated with the face is obscured, there may not be a pose model associated with the body in the pose array. If every pose 'fails' the comparison 710 (i.e., progressing directly to step 712 to increment the pose index), the best pose returned 720 by the logic circuitry 440 may still be the initialized 'null' value, thereby indicating a matching pose for the face has not been detected.

The methods 600, 700 of FIGS. 6 and 7 may be performed at least for each newly detected pose and face, respectively, in the captured image data. That is, previously linked hands, poses, and faces may remain linked without requiring the methods 600, 700 to be performed again for subsequent image data. When key user data elements are generated by the logic circuitry 440, the generated key user data elements may be compared to previously generated key user data elements and data objects to determine (i) if new user data needs to be generated (and the methods 600, 700 performed for new hands, poses, and/or faces of the generated key user data elements), and (ii) if existing data within the previously generated user data should be updated based at least partially on the generated key user data elements.

With respect again to FIG. 5, in addition to annotations associated with potential users detected, the frame 500 further includes an input boundary box 516 that encapsulates the user input zone. As mentioned previously, the user input zone may be predetermined and fixed, or the user input zone may be variable based on the detected user input. In the example embodiment, the input boundary box 516 is based on where the user 501 has touched the touchscreen. More specifically, the logic circuitry 440 is configured to map touch coordinates from the touch screen to the image data to define the user input zone where a hand, finger, or the like of a user providing the user input is likely to be positioned within the image data.

The user input zone may then be compared to detected hands and/or fingers within the image data to identify which, if any, of the potential users in the image data is associated with the user input. As described in detail herein, if the potential user matching the user input does not also have a matching face, pose, and hand (in addition to another other human features detected by the logic circuitry 440), the logic circuitry 440 may determine that suspicious activity may be occurring. The logic circuitry 440 may then escalate to, for example and without limitation, issuing additional authorization or authentication challenges, notify an attendant or attendant device, and/or block the restricted action from access for a period of time.

Figure 8:
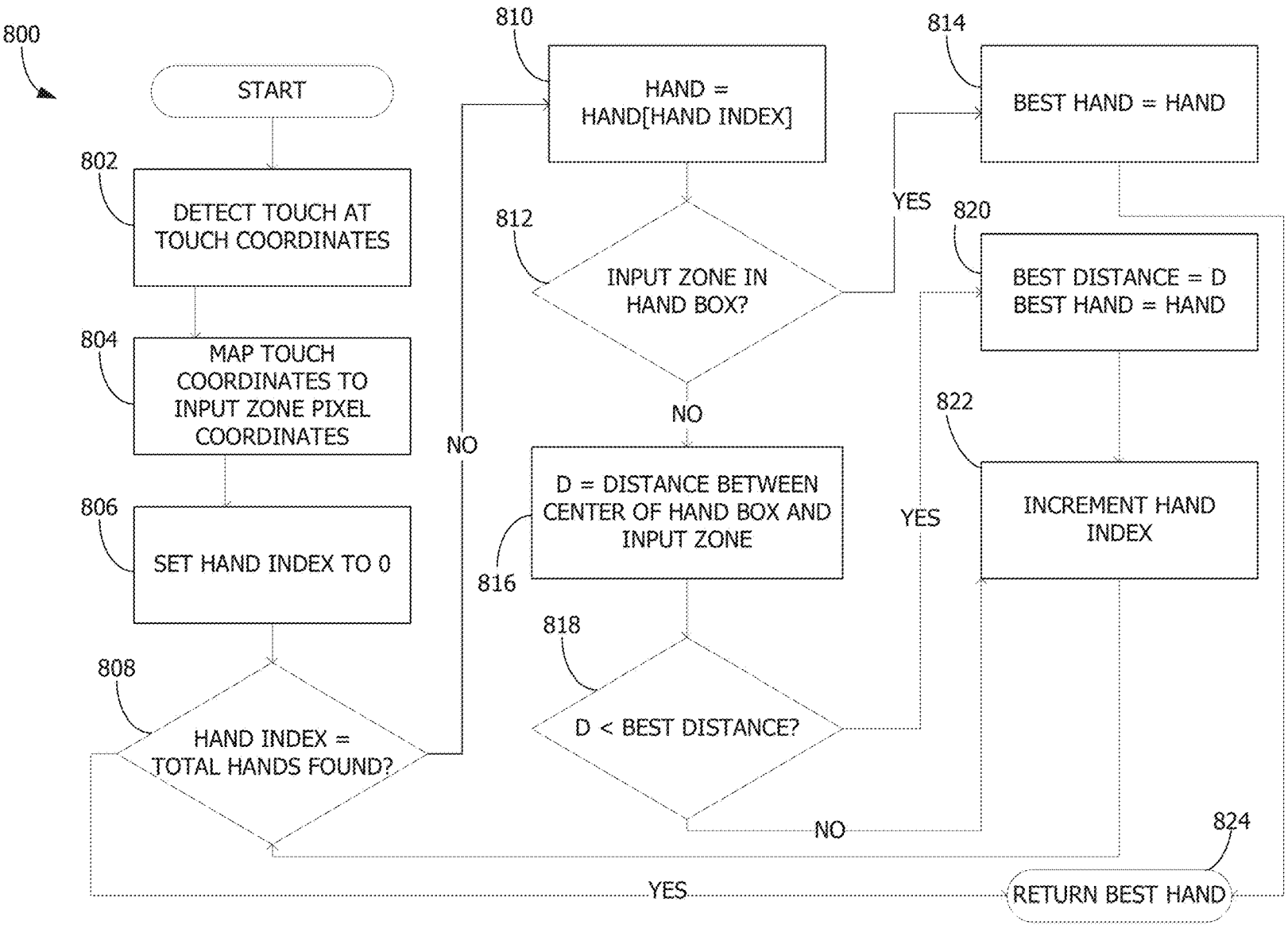
FIG. 8 is a flow diagram of an example method for linking key user data elements representing hands to an input zone associated with detected user input on a touchscreen in accord with at least some aspects of the disclosed concepts.

FIG. 8 is a flow diagram of an example method 800 for matching a potential user to a user input zone. The method 800 is substantially similar to the method 600 shown in FIG. 6 for matching a wrist of a pose model to a hand detected in the image data. Although the method 800 matches hands to the user input zone, it is to be understood that the method 800 may also apply to other human characteristics (e.g., fingers). In other embodiments, the method 600 may include additional, fewer, or alternative steps, including those described elsewhere herein. The steps below may be described in algorithmic or pseudo-programming terms such that any suitable programming or scripting language may be used to generate the computer-executable instructions that cause the logic circuitry 440 (shown in FIG. 4) to perform the following steps. In certain embodiments, at least some of the steps described herein may be performed by other devices in communication with the logic circuitry 440.

In the example embodiment, the logic circuitry 440 detects 802 user input representing a user touching a touchscreen. More specifically, the logic circuitry 440 receives touch coordinates (e.g., for a two-dimensional touch screen, in an (x,y) format) that indicate the location of the touch on the touchscreen. These touch coordinates may be used to determine one or more actions associated with the user input, such as selection of an option displayed on the touchscreen. The logic circuitry 440 then maps 804 the touch coordinates to the pixel coordinates of a user input zone. That is, the logic circuitry 440 translates the touch coordinates from a plane defined by the touchscreen surface (x,y) to a plane defined by the pixels of the image data (u,v), and then forms the user input zone based on the translated pixel coordinates. The user input zone may include the pixel coordinates, but is primarily focus upon pixels representing a physical area in which a hand of the user providing the user input is expected to be within the image data. In the example embodiment, similar to FIG. 5, this includes a physical area extending outward from the touchscreen at the touch coordinates.

In addition to establishing the user input zone, several other variables are initialized prior to any hand comparison. In the example embodiment, the logic circuitry 440 sets a best distance value to a predetermined max value and a best hand variable to 'null'. The best distance and best hand variables are used in combination with each other to track the hand that is the best match to the user input zone and to facilitate comparison with subsequent hands to determine whether or not the subsequent hands are better matches for the user input zone. The logic circuitry 440 also sets 806 a hand index variable to '0'. In the example embodiment, the key user data elements associated with each hand within the captured image data may be stored in an array such that each cell within the hand array is associated with a respective hand. The hand index variable may be used to selectively retrieve data associated with a particular hand from the hand array.

At step 808, the logic circuitry 440 determines whether or not the hand index is equal to (or greater than, depending upon the array indexing format) the total number of hands found within the captured image data. For the initial determination, the hand index is 0, and as a result, the logic circuitry 440 proceeds to set 810 a prospective hand for comparison to the hand associated with the first cell of the hand array (in the format shown in FIG. 6, HAND[ ] is the hand array, and HAND[0] is the first cell of the hand array, where '0' is the value indicated by the HAND INDEX). In the example embodiment, the data stored in the hand array for each hand may include coordinate data of a hand boundary box. The coordinate data may be a center point of the boundary box, corner coordinates, and/or other suitable coordinates that may describe the position of the hand boundary box relative to the captured image data.

The logic circuitry 440 determines 812 whether or not the user input zone (or a set of pixel coordinates representing the user input zone) coordinates are located within the hand boundary box of the hand from the hand array. If the user input zone coordinates are located with the hand boundary box, then the hand may be considered a match to the user input zone and the potential user. In the example embodiment, the logic circuitry 440 may then set 814 the hand as the best hand and return 824 the best hand. The best hand may then be associated with user input detected in the input zone and stored as part of a user data object of the user for determining the authorization status of the user for a restricted action. Returning 824 the best hand may terminate the method 800 without continuing through the hand array, thereby freeing up resources of the logic circuitry 440 for other functions, such as other iterations of the method 800 for different detected user inputs. In other embodiments, the logic circuitry 440 may compare the user input zone to each and every hand prior to returning 824 the best hand irrespective of whether the user input zone coordinates are located within a hand boundary box, which may be beneficial in image data with crowded bodies and hands.

If the user input zone coordinates are not determined to be within the hand boundary box of the current hand, the logic circuitry 440 calculates 816 a distance D between the center of the hand boundary box and the user input zone coordinates. The logic circuitry 440 then compares 818 the calculated distance D to the best distance variable. If the calculated distance D is less than the best distance, the current hand is, up to this point, the best match to the user input zone. The logic circuitry 440 sets 820 the best distance variable equal to the calculated distance and the best hand to be the current hand. For the first hand from the hand array, the comparison 818 may automatically progress to setting 820 the best distance to the calculated distance and the best hand to the first hand because the initial best distance may always be greater than the calculated distance. The logic circuitry 440 then increments 822 the hand index such that the next hand within the hand array will be analyzed through steps 810-822. The hand index is incremented 822 irrespective of the comparison 818, but step 820 is skipped if the calculated distance is greater than or equal to the best distance.

After each hand of the hand array is compared to the user input zone, the hand index is incremented to a value beyond the addressable values of the hand array. During the determination 808, if the hand index is equal to the total number of hands found (or greater than in instances in which the first value of the hand array is addressable with a hand index of '1'), then every hand has been compared to the user input zone, and the best hand to match the user input zone may be returned 824. In certain embodiments, to avoid scenarios in which the real hand associated with the user input zone is covered from view of the capture image data and the best hand as determined by the logic circuitry 440 is relatively far away from the user input zone, the logic circuitry 440 may compare the best distance associated with the best hand to a distance threshold. If the best distance is within the distance threshold (i.e., less than or equal to the minimum distance), the best hand may be returned 824. However, if the best distance is greater than the distance threshold, the best hand variable may be set back to a 'null' value and returned 824. The null value may indicate to other modules of the logic circuitry 440 and/or other devices that the hand associated with the user input zone is not present in the captured image data.

As described herein, the methods 600, 700, and 800 shown in FIGS. 6-8 link various key user data elements together to represent potential users and to tie one potential user to a detected user input. For authorized users, it may be relatively easy for the users to provide the system 400 with a full (or nearly full) set of matching key user data elements. That is, each form of key user data elements may be generated and linked together with relative ease for authorized user. Even in the event of missing key user data elements, authorized user may simply need to reposition themselves relative to the image sensor 460 to provide a clear image, which may not be an issue for an authorized user operating the gaming device 410 due to the proximity of the user. In contrast, unauthorized users may attempt to mask one or more features that the system 400 is configured to detect in an effort to fraudulently access the restricted actions, which may result in partial or missing sets of key user data elements. For example, if an unauthorized user is holding a picture of a face in front of his or her real face to trick the gaming device 410 into performing the restricted action, the key user data elements of the pictured face may not align with the pose model of the user. In another example, the unauthorized user may attempt to provide user input while positioned outside of the image data, which results in the system 400 unable to identify a user that matches the user input from the image data.

These inconsistencies as determined by the logic circuitry 440 may cause the logic circuitry to identify suspicious access attempts of the restricted action. A suspicious access attempt may not necessarily be an unauthorized user attempting access of the restricted action, but rather is a possibility based on the factors generated and analyzed by the logic circuitry 440. The logic circuitry 440 may then escalate the authorization process to enable authorized users to provide additional data that indicates their authorized status and/or to prevent unauthorized user from gaining access to the restricted action. For example, additional authentication or authorization challenges may be presented at the gaming device 410. The challenges may be as simple as requesting the user repeat the user input while being in clear sight of the image sensor 460, or request additional information, such as biometric data or an identification number or card. An attendant or attendant device may be notified of the suspicious behavior to enable the attendant to selectively permit or prevent the restricted action.

Figure 9:
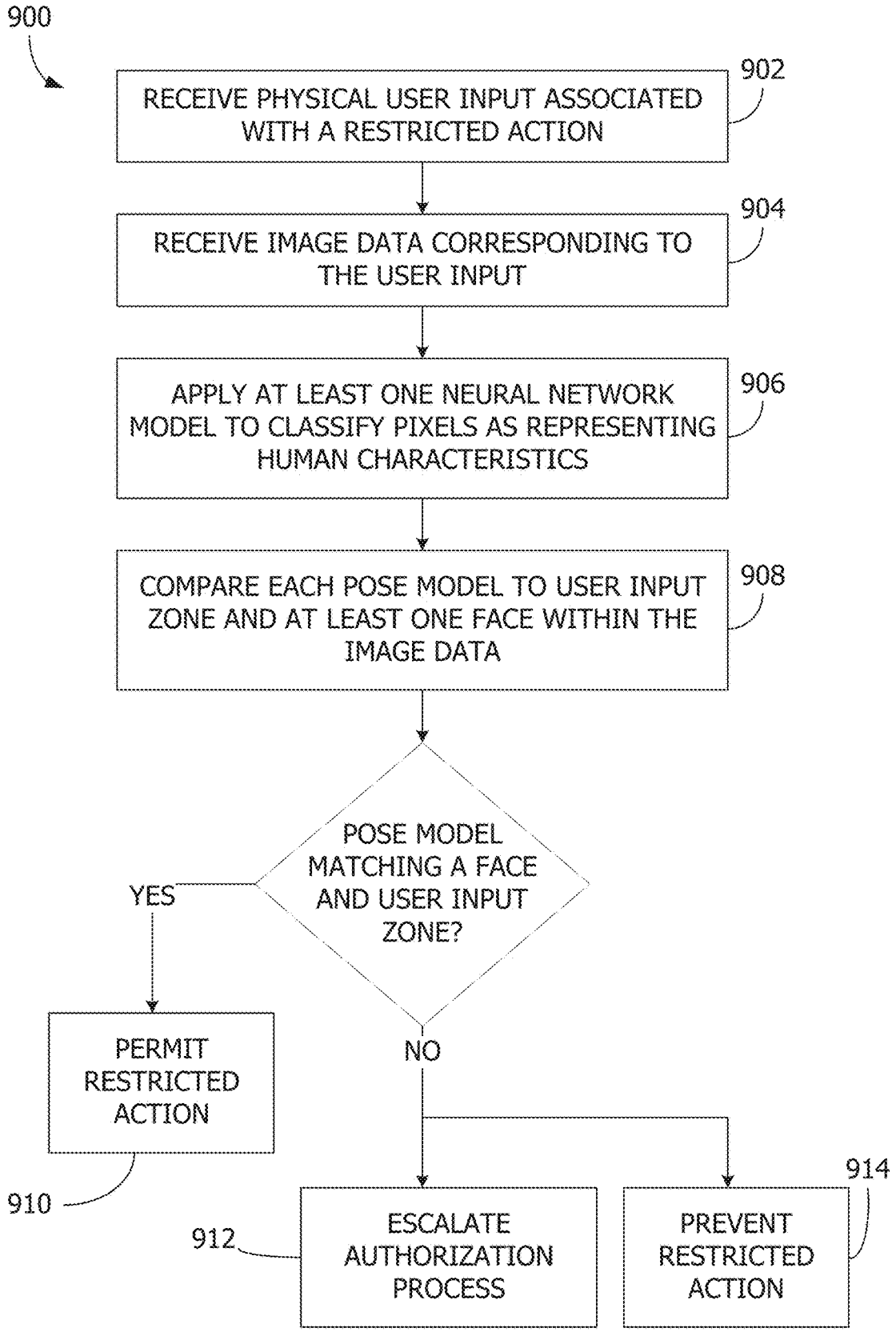
FIG. 9 is a flow diagram of an example authorization method in accord with at least some aspects of the disclosed concepts.

FIG. 9 is a flow diagram of an example authorization method 900 using the system 400 (shown in FIG. 4). The method 900 may be at least partially performed using the logic circuitry 440 of the system 400. In other embodiments, other devices may perform at least some of the steps, and the method 900 may include additional, fewer, or alternative steps, including those described elsewhere herein.

In the example embodiment, the logic circuitry 440, via a user input device 450, receives 902 or detects physical user input from a user and that is associated with a restricted action. For example, the user may provide the user input to initiate a wager or purchase a lottery ticket. In certain embodiments, based on the user input coordinates of the user input, the logic circuitry 440 may establish a user input zone associated with the user input. The logic circuitry 440 then receives 904 image data from one or more image sensors 460. The image data corresponds to the user input such that the image data is captured substantially near to or at the time of the user input. The image data may be received 904 as a stream of video data or as an image that is captured in response to the user input.

The logic circuitry 440 then applies 906 at least one neural network model to the received image data to classify pixels of the received image data as representing human characteristics and/or other features, such as a user input zone. The human characteristics may be categorized at least to represent faces and pose models, where the pose models include feature points representing hands and/or fingers of the poses. In at least some embodiments, the hands and/or fingers may have key user data elements separate from the pose models (e.g., hand boundary boxes). The key user data elements generated from the application 906 of the neural network models include pixel coordinate data that represent a location of the associated with human characteristic within the image data.

The logic circuitry 440 compares 908 the pixel coordinates of the key user data elements representing the human characteristics and the pixel coordinates of the user input zone to match the human characteristics together to form potential users and identify which, if any, potential user is associated with the user input. More specifically, in the example embodiment, each pose model is compared to the faces and the user input zone to identify any matches. In other embodiments in which hands and/or fingers have key user data elements separate from the pose models, the hands and/or fingers may be compared to each pose model (which may still be compared to the detected faces in the image data) and the user input zone.

Based on the comparison, the logic circuitry 440 may determine whether or not to proceed with the restricted action. In the example embodiment, in response to a pose model matching a face and the user input zone, the logic circuitry 440 permits 910 the restricted action. That is, a full set of key user data elements is detected for the user associated with the user input, and therefore is determined to be an authorized user. In at least some embodiments, additional security checks may be performed prior to permitting 910 the restricted action. For example, the user may be required to present an identification card to verify his or her identity before the restricted action is permitted 910. If, however, none of the pose models match both a face and the user input zone, the logic circuitry 440 may escalate 912 the authorization process and/or prevent 914 the restricted action from being performed. Escalating 912 the authorization process may include, but is not limited to, presenting the user with an additional authentication challenge or alerting an attendant (directly or via an attendant device).

In certain embodiments, the method 900 may be performed once for authorized users during a session of operating the gaming device 410 such that subsequent user input associated with restricted actions may automatically be permitted, thereby reducing the computational burden and resource allocation to the method 900. In such embodiments, the key user data elements may be stored for identifying the user in subsequent image data. If a different user is detected provided user input or the session is determined to have concluded, then the method 900 may be initiated for the next user input associated with a restricted action. In other embodiments, the method 900 may be repeated for each and every instance of user input associated with a restricted action.

Each of these embodiments and obvious variations thereof is contemplated as falling within the spirit and scope of the claimed invention, which is set forth in the following claims. Moreover, the present concepts expressly include any and all combinations and subcombinations of the preceding elements and aspects.

The invention claimed is:

1. A gaming terminal comprising:

an input device configured to receive physical user input from a user;

an image sensor configured to capture image data of a user area associated with the gaming terminal; the input device being at a predetermined location relative to the user area; and logic circuitry communicatively coupled to the input device and the image sensor, the logic circuitry configured to:

detect user input received at the input device, the detected user input associated with a restricted action;

receive, via the image sensor, image data of the captured image data, the received image data corresponding to the detected user input;

apply at least one neural network model to the received image data to classify pixels of the received image data as representing human characteristics, the human characteristics including at least one face and at least one pose model;

based at least partially on (i) pixel coordinates of the human characteristics within the received image data and (ii) pixel coordinates of a user input zone within the image data and associated with the detected user input, compare each of the at least one pose model to the user input zone and the at least one face; and based on the comparison, in response to one of the at least one pose model matching (i) a face of the at least one face and (ii) the user input zone, permit the restricted action.

2. The gaming terminal of claim 1, wherein the gaming terminal includes a three-dimensional camera including the image sensor.

3. The gaming terminal of claim 2, wherein each of the human characteristics has an associated depth detected by the three-dimensional camera, the logic circuitry configured to remove the human characteristics having an associated depth exceeding a depth threshold.

4. The gaming terminal of claim 1, wherein, in response to applying the at least one neural network model to the received image data resulting in an absence of any face or pose model, the logic circuitry is configured to present the user with an authentication challenge.

5. The gaming terminal of claim 1, wherein applying the at least one neural network model to the received image data includes classifying pixels of the received image data as representing a display device, and wherein the logic circuitry is configured to present the user with an authentication challenge in response to determining that the display device in the image data is displaying one or more human characteristics.

6. The gaming terminal of claim 1, wherein the input device is a touchscreen, the detected user input associated with touch coordinates indicating a location on the touchscreen of the detected user input, wherein the logic circuitry is configured to calculate the pixel coordinates of the input zone at least partially as a function of the touch coordinates.

7. The gaming terminal of claim 1, wherein the logic circuitry transmits an alert to an attendant device associated with the gaming terminal in response to none of the at least one pose model matching either (i) any face of the at least one face and (ii) the input zone.

8. The gaming terminal of claim 7, wherein the alert is transmitted to the attendant device further in response to the user failing the authentication challenge.

9. A method for authentication a user at a gaming terminal of a gaming system, the gaming system including at least one image sensor and logic circuitry in communication with the gaming terminal and the at least one image sensor, the method comprising:

receiving, by an input device of the gaming terminal, physical user input from the user, the physical user input associated with a restricted action;

receiving, by the logic circuitry via the at least one image sensor, image data that corresponds to the physical user input;

applying, by the logic circuitry, at least one neural network model to the received image data to classify pixels of the received image data as representing human characteristics, the human characteristics including at least one face and at least one pose model;

based at least partially on (i) pixel coordinates of the human characteristics within the received image data and (ii) pixel coordinates of a user input zone within the image data and associated with the physical user input, comparing, by the logic circuitry, each of the at least one pose model to the user input zone and the at least one face; and based on the comparison, in response to one of the at least one pose model matching (i) a face of the at least one face and (ii) the user input zone, permitting, by the logic circuitry; the restricted action.

10. The method of claim 9, wherein the at least one image sensor includes a three-dimensional camera, and wherein each of the human characteristics has an associated depth detected by the three-dimensional camera, the method further comprising removing, by the logic circuitry, the human characteristics having an associated depth exceeding a depth threshold.

11. The method of claim 9 further comprising, in response to applying the at least one neural network model to the received image data resulting in an absence of any face or pose model, presenting, by the logic circuitry, the user with an authentication challenge.

12. The method of claim 9, wherein applying the at least one neural network model to the received image data includes classifying pixels of the received image data as representing a display device, and wherein the method further comprises presenting, by the logic circuitry, the user with an authentication challenge in response to determining that the display device in the image data is displaying one or more human characteristics.

13. The method of claim 9, wherein the input device is a touchscreen, the physical user input associated with touch coordinates indicating a location on the touchscreen of the physical user input, and wherein the method further comprises calculating, by the logic circuitry, the pixel coordinates of the input zone at least partially as a function of the touch coordinates.

14. The method of claim 9 further comprising transmitting, by the logic circuitry, an alert to an attendant device associated with the gaming terminal in response to none of the at least one pose model matching either (i) any face of the at least one face and (ii) the input zone.

15. A gaming system comprising:

a gaming terminal comprising an input device configured to receive physical user input from a user;

an image sensor configured to capture image data of a user area associated with the gaming terminal, the input device being at a predetermined location relative to the user area; and logic circuitry communicatively coupled to the input device and the image sensor, the logic circuitry configured to:

detect user input received at the input device, the detected user input associated with a restricted action;

receive, via the image sensor, image data of the captured image data, the received image data corresponding to the detected user input;

apply at least one neural network model to the received image data to classify pixels of the received image data as representing human characteristics, the human characteristics including at least one face and at least one pose model;

based at least partially on (i) pixel coordinates of the human characteristics within the received image data and (ii) pixel coordinates of a user input zone within the image data and associated with the detected user input, compare each of the at least one pose model to the user input zone and the at least one face; and based on the comparison, in response to one of the at least one pose model matching (i) a face of the at least one face and (ii) the user input zone, permit the restricted action.

16. The gaming system of claim 15 further comprising a three-dimensional camera including the image sensor, wherein each of the human characteristics has an associated depth detected by the three-dimensional camera, the logic circuitry configured to remove the human characteristics having an associated depth exceeding a depth threshold.

17. The gaming system of claim 15, wherein, in response to applying the at least one neural network model to the received image data resulting in an absence of any face or pose model, the logic circuitry is configured to present the user with an authentication challenge.

18. The gaming system of claim 15, wherein the input device is a touchscreen, the detected user input associated with touch coordinates indicating a location on the touchscreen of the detected user input, wherein the logic circuitry is configured to calculate the pixel coordinates of the input zone at least partially as a function of the touch coordinates.

19. The gaming system of claim 15, wherein the logic circuitry transmits an alert to an attendant device associated with the gaming terminal in response to none of the at least one pose model matching either (i) any face of the at least one face and (ii) the input zone.

20. The gaming system of claim 19, wherein the alert is transmitted to the attendant device further in response to the user failing the authentication challenge.

* * * * *